US010858822B2

(12) United States Patent
Mori et al.

(10) Patent No.: US 10,858,822 B2
(45) Date of Patent: Dec. 8, 2020

(54) CONSTRUCTION AND METHOD FOR CONSTRUCTING SAME

(71) Applicant: IIDA SANGYO CO., LTD., Musashino (JP)

(72) Inventors: Kazuhiko Mori, Tokyo (JP); Moriyasu Nagayoshi, Tokyo (JP)

(73) Assignee: IIDA SANGYO CO., LTD., Tokyo (JP)

( * ) Notice: Subject to any disclaimer, the term of this patent is extended or adjusted under 35 U.S.C. 154(b) by 0 days.

(21) Appl. No.: 16/074,388

(22) PCT Filed: Nov. 20, 2017

(86) PCT No.: PCT/JP2017/041645
§ 371 (c)(1),
(2) Date: Jul. 31, 2018

(87) PCT Pub. No.: WO2018/101101
PCT Pub. Date: Jun. 7, 2018

(65) Prior Publication Data

US 2019/0145092 A1 May 16, 2019

(30) Foreign Application Priority Data

Nov. 30, 2016 (JP) ..... 2016-232415

(51) Int. Cl.
*E04B 1/26* (2006.01)
*E04B 1/58* (2006.01)

(52) U.S. Cl.
CPC ..... *E04B 1/2604* (2013.01); *E04B 1/26* (2013.01); *E04B 1/5831* (2013.01);
(Continued)

(58) Field of Classification Search
CPC ..... E04B 1/2604; E04B 1/5831; E04B 1/26; E04B 2001/2672; E04B 2001/5887; E04B 2001/262; E04B 2/70
(Continued)

(56) References Cited

U.S. PATENT DOCUMENTS 198,926 A * 1/1878 Boyd ..... E04B 1/2612 403/170
533,203 A * 1/1895 Stange ..... E04B 1/2612 403/232.1
(Continued)

FOREIGN PATENT DOCUMENTS

CA 2908732 A1 * 4/2017 ..... E04B 1/00
DE 826347 C * 12/1951 ..... E04B 1/26
(Continued)

OTHER PUBLICATIONS

Jan. 23, 2018 International Search Report issued in International Patent Application No. PCT/JP2017/041645.

*Primary Examiner* — Patrick J Maestri
*Assistant Examiner* — Joseph J. Sadlon
(74) *Attorney, Agent, or Firm* — Oliff PLC

(57) ABSTRACT

A construction having generalized and alternative joints, capable of making pillar materials self-stood at in horizontal direction of lower frame materials. Upper and lower frame materials formed by laminating three sawn plates with two or more different plate width in plate thickness direction, and a recessed groove or a protruding stripe of the alternative joints is formed between outer layer plate width of outer layer sawn plates interposing an intermediate layer of laminated layers and an intermediate plate width of intermediate sawn plate interposed as the intermediate layer. The pillar materials are formed by laminating three sawn plates with same length in plate thickness direction, and a protrusion or a recess, which can be fitted closely to the recessed groove
(Continued)

or the protruding stripe, are formed at both ends by deviating an intermediate sawn plate in a longitudinal direction for a distance of the difference to outer layer sawn plates.

9 Claims, 16 Drawing Sheets

(52) U.S. Cl.
CPC . *E04B 2001/262* (2013.01); *E04B 2001/2672* (2013.01); *E04B 2001/5887* (2013.01)

(58) Field of Classification Search
USPC ..... 52/648.1
See application file for complete search history.

(56) References Cited

U.S. PATENT DOCUMENTS 733,500 A * 7/1903 Moore ..... F16B 5/02 403/376
1,102,036 A * 6/1914 Ganter ..... B27M 3/002 144/347
1,371,744 A * 3/1921 Een ..... E04B 1/2604 403/219
1,377,891 A * 5/1921 Knight ..... E04C 3/122 52/841
1,652,612 A * 12/1927 Daniels ..... E04B 1/26 403/364
1,778,333 A * 10/1930 Neumann ..... B27D 1/04 52/847
1,935,037 A * 11/1933 Madsen ..... E06B 1/62 49/404
2,105,327 A * 1/1938 McNamara ..... E04B 2/82 52/250
2,297,058 A * 9/1942 Hasenburger ..... E04B 1/26 52/654.1
2,385,142 A * 9/1945 Lank ..... E04C 3/17 52/639
2,401,588 A * 6/1946 Smith ..... E04B 1/26 52/464
2,587,804 A * 3/1952 Ajne ..... E04B 1/26 52/578
3,004,364 A * 10/1961 Benkelman ..... A63H 33/108 446/122
3,285,636 A * 11/1966 Hoyle, Jr. ..... E04B 1/2604 403/230
3,304,677 A * 2/1967 Pavlecka ..... E04C 2/08 52/277
3,466,821 A * 9/1969 Cooper ..... E04B 2/80 52/204.1
3,473,277 A * 10/1969 Straight ..... E04B 2/702 52/233
3,553,921 A * 1/1971 Breistein ..... E04B 1/80 52/592.1
3,681,888 A * 8/1972 Kim ..... A47B 96/145 52/836
3,774,362 A * 11/1973 Matuschek ..... E04B 1/10 52/206
3,813,841 A * 6/1974 Tsurumi ..... A63H 33/082 52/648.1
3,815,305 A * 6/1974 Grung ..... E04B 1/185 52/264
3,892,097 A * 7/1975 Bain ..... E04B 1/2604 52/233
3,908,322 A * 9/1975 Shoaf ..... E04B 2/70 52/92.1
4,089,144 A * 5/1978 Astl ..... E04B 1/18 446/110
4,144,692 A * 3/1979 Jonas ..... E04B 1/20 52/169.9
4,171,591 A * 10/1979 Fischer ..... A63H 33/105 446/127
4,224,774 A * 9/1980 Petersen ..... E04B 2/707 52/309.14
4,458,465 A * 7/1984 Coe ..... E04C 3/14 52/837
4,479,342 A * 10/1984 Eberle ..... E04B 1/26 33/613
4,555,889 A * 12/1985 Mankowski ..... E04C 3/32 52/241
4,558,968 A * 12/1985 Meickl ..... E04B 1/2604 403/174
4,575,982 A * 3/1986 Wenger ..... E04F 13/10 52/384
5,002,105 A * 3/1991 Bodig ..... B27D 1/04 144/346
5,074,092 A * 12/1991 Norlander ..... B32B 21/13 52/455
5,195,282 A * 3/1993 Campbell ..... E04B 1/0007 446/115
5,361,554 A * 11/1994 Bryan ..... E04B 5/12 52/480
5,647,185 A * 7/1997 Forlini ..... E04B 2/06 405/284
5,661,499 A * 8/1997 Epshtein ..... H01Q 15/08 343/909
5,720,568 A * 2/1998 Kairi ..... E04B 1/2604 403/12
6,025,053 A * 2/2000 Grenier ..... B07C 5/14 144/332
6,125,608 A * 10/2000 Charlson ..... E04B 1/7604 52/404.1
6,141,927 A * 11/2000 Usui ..... E01C 9/08 403/170
6,212,846 B1 * 4/2001 Johnston ..... E04B 5/12 156/257
6,374,880 B2 * 4/2002 Macpherson ..... B27D 1/04 144/350
6,694,685 B2 * 2/2004 Celata ..... E04B 1/26 52/241
6,694,699 B2 * 2/2004 Dowland ..... E04B 1/26 52/296
6,837,016 B2 * 1/2005 Simmons ..... E04B 1/2403 52/655.1
8,789,325 B2 * 7/2014 Verhaeghe ..... E04B 2/08 52/233
8,915,042 B2 * 12/2014 Ahn ..... E04B 1/24 52/236.6
8,935,892 B2 * 1/2015 Buchanan ..... E04B 1/10 248/560
8,973,320 B2 * 3/2015 Harper ..... E04C 3/30 52/233
9,096,975 B2 * 8/2015 Rischmueller ..... E04F 15/08
9,249,574 B2 * 2/2016 Mei ..... E04B 5/12
9,327,446 B2 * 5/2016 Clark ..... B29C 66/41
9,562,351 B2 * 2/2017 Ibrahim ..... E04B 1/2604
9,631,415 B2 * 4/2017 Eisenbarth ..... E06B 1/08
9,879,413 B2 * 1/2018 Castelli ..... E04B 1/1903
10,011,984 B2 * 7/2018 Verraes ..... E04B 1/348
10,711,462 B1 * 7/2020 Gilbert ..... E04C 3/36
2004/0118056 A1 * 6/2004 Peters ..... A63H 33/084 52/79.1
2008/0053031 A1 * 3/2008 Sandoz ..... E04B 5/12 52/649.1
2008/0302037 A1 * 12/2008 Brown ..... E04B 5/12 52/289
2010/0236172 A1 * 9/2010 Wirth ..... E04B 1/26 52/309.4
2013/0022814 A1 * 1/2013 Lin ..... B32B 21/13 428/397
2017/0370090 A1 * 12/2017 Perez-Romero ..... E04B 1/2604

FOREIGN PATENT DOCUMENTS

DE 8624542 U1 2/1987
EP 3366855 A1 * 8/2018 ..... E04B 1/2604
FR 2186582 A1 * 1/1974 ..... E04B 1/26
GB 2104612 A * 3/1983 ..... E04B 1/2604

(56) References Cited

FOREIGN PATENT DOCUMENTS

| | | | | | |
|---|---|---|---|---|---|
| GB | 2178816 | A | * | 2/1987 | ..... E04B 1/2604 |
| JP | S53-90613 | A | | 8/1978 | |
| JP | H05-85904 | U | | 11/1993 | |
| JP | H07-13917 | U | | 3/1995 | |
| WO | WO-2015011300 | A1 | * | 1/2015 | ..... E04B 1/26 |

* cited by examiner

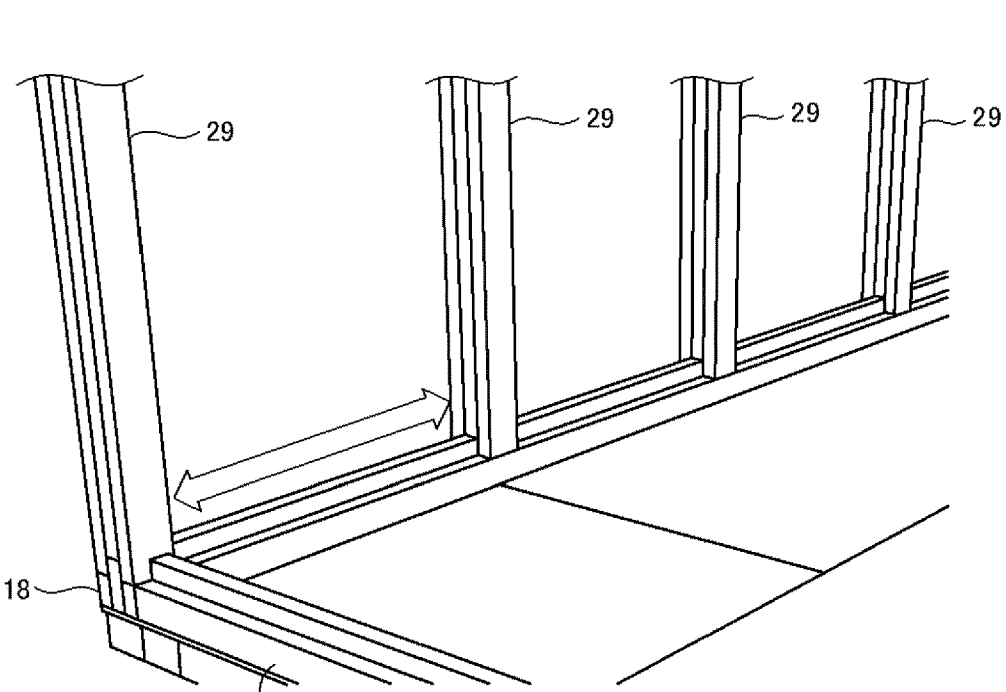
Fig.1C
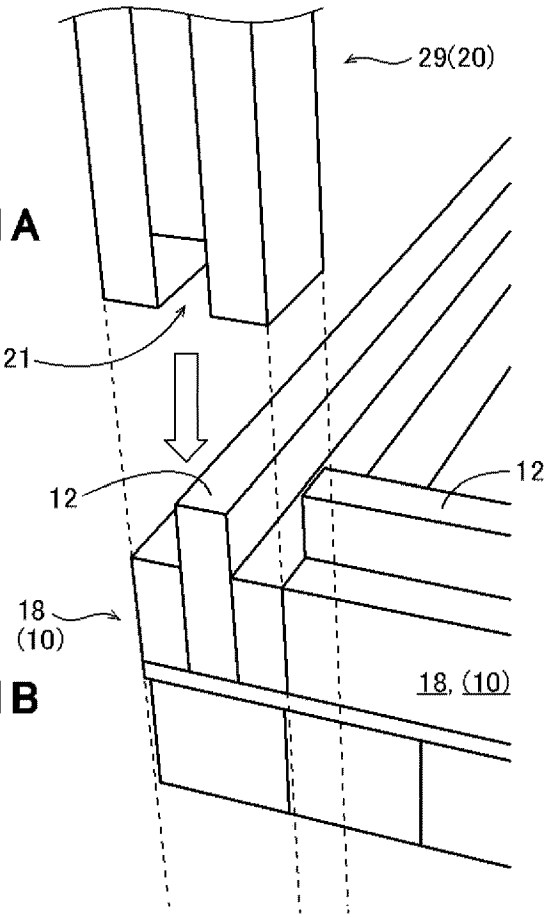
Fig.1A
Fig.1B

CONSTRUCTION AND METHOD FOR CONSTRUCTING SAME

BACKGROUND OF THE INVENTION

Field of the Invention

Present invention relates to a construction and a method for constructing same. This application is based upon and claims the benefit of priority from the Japanese Patent Application No. 2016-232415 filed in Japan on Nov. 30, 2016.

Description of Related Art

Recently, a construction (hereinafter, may be referred to as "two-by-four construction" or "2×4 building") by wooden wall frame construction method (hereinafter, may be referred to as "two-by-four construction method" or "2×4 construction method"), which is becoming popular, is having a characteristics capable of shortening a construction period compared to a conventional wooden house. However, this "2×4 building" is having a defect that it is troublesome to fix panels at precise positions, as walls are constructed by connecting panels. It is because, in a building of this structure, panels are fastened by nails around peripheral edge of a floor constructed in planar shape, so it tends to occur position displacement in all directions. In addition, panels to be fixed one by one in adjacent to panels previously fixed on the floor need to be connected precisely in identical plane. If adjacent panels are not connected in planar shape, it is not possible to finish finely as there will be unevenness on a surface of interior material.

It is necessary for workers to support panels in both indoor side and outdoor side of panels and to adjust its fixing position, in order to connect adjacent panels precisely in identical plane. The workers at indoor side can support panels safely on a floor. However, the workers at outdoor side need to support panels on scaffolding. When constructing a wall of second stairs, it will be a work at high scaffolding, so it will be considerably dangerous work to support heavy panels. Especially, when panels incline for outdoor side, it is necessary for the workers on scaffolding to support inclined panels, and it will be an extremely dangerous condition. Further, weight of a panel, which is enlarged to improve construction efficiency, is more than 100 kg, and it is extremely dangerous to support this panel on high scaffolding.

Here, "2×4 building" solving these defects, in other words, a technology for making the work safe by efficiently fixing panels easily at precise positions is disclosed in Patent Literature 1. More concretely, the panels are positioned at indoor side and having hooking protrusion at side edge thereof. The hooking protrusion is locked at indoor side of laterally adjacent panel. It is possible to fix panels at fixed position by preventing panels from falling down, by connecting the hooking protrusion to the adjacent panel as the above.

On the other hand, about a construction of log house different from "2×4 building", a technology for resolving damage and distortion by making drying of crossing part uniform, and also, for preventing rain water from intruding into indoor by treatment of rain water, is disclosed in Patent Literature 2. More concretely, (a) in a joint, a fitting recess for fitting in cross direction of left and right is drilled, an upper recess and lower recess for fitting in cross direction of up and down are drilled, and a core is formed inside, at four corners in which the fitting recess and a body are connected, connecting surfaces are formed to be in planes 45 degrees with respect to a longitudinal direction of a log, and in the core, a rounded protruding surface in semi-cylindrical shape is formed on top surface along a longitudinal direction of a log, and a rounded recessed surface is formed at bottom along perpendicular direction to be corresponding to the rounded protruding surface, and also, vertical grooves are drilled at both side surfaces for guiding falling water downward, (b) in the body, at least two rows or more protruding banks are provided in parallel on top surface, and outer sides of the protruding banks will be connection surfaces in which upper and lower logs overlaps, a body cavity is formed between the protruding banks, in which a little gap is formed when the logs are overlapped, and also, a recessed groove is drilled at bottom surface for fitting with the protruding banks, (c) a water draining hole inclined to outside is formed in a base.

Patent Literature 1: JP H5-85904 Y

Patent Literature 2: JP H7-13917 Y

SUMMARY OF THE INVENTION

However, in Patent Literature 1, as it is described that weight of a panel, which is enlarged to improve construction efficiency, is more than 100 kg, and that it is extremely dangerous to support this panel on high scaffolding, at construction site of "2×4 building", it has been considered that a work to fit a panel with weight more than 100 kg by plural workers is basically inevitable. On the other hand, at construction site of "2×4 building", there was a request to be able to fit from one relatively lightweight pillar, and to make a work to fit large and heavy panel by plural workers unnecessary.

In addition, in Patent Literature 2, a structure of log house having a joint to fit protruding banks formed at one wood and a recessed groove or a fitting recess formed at other wood can expect an effect to resolve damage and distortion by making drying of crossing part uniform, and also, to prevent rain water from intruding into indoor by treatment of rain water.

However, even with the joint to fit the protruding banks and the recessed groove or the fitting recess, as described in Patent Literature 2, it was not completed as a countermeasure for eliminating a work to fit a panel with weight more than 100 kg by plural workers at construction site of "2×4 building".

The present invention was invented considering these problems, and the purpose of the present invention is to provide a construction capable of completing framework in short period with few workers by making pillars, which are relatively lightweight and can be supported by one worker, self-stood independently at free position in horizontal direction of upper frames or lower frames, and by making the work to fit large and heavy panel by plural workers unnecessary at construction site. Further, the purpose of the present invention is to provide a construction to improve productivity by simplifying and omitting joint process according to inherent standing position of the pillars with respect to horizontal members.

The present invention is invented to achieve these purposes, and the invention described in claim 1 is a wooden construction (100) having structural materials for assembling by fitting horizontal members (10) and vertical members (20), wherein at fitting parts of the structural materials, alternative joints are formed for fitting the vertical members (20) closely to the horizontal members (10) at optional position in horizontal direction of the horizontal members (10) to be able to make the vertical members (20) self-stood, the horizontal members compose upper frame materials (19) and lower frame materials (17, 18), and a recessed groove (11) or a protruding stripe (12) formed over entire length (K) in longitudinal direction of each of the horizontal members forms one of the alternative joints, the vertical members (20) compose pillar materials (29) or framework walls (50), and each of the pillar materials (29) are formed with a protrusion (22) or a recess (21) at both ends (26, 27), which can be fitted closely to the recessed groove (11) or the protruding stripe (12), the horizontal members (10) compose each of the upper frame materials (19) and the lower frame materials (17, 18) by laminating three sawn plates (1 to 3, 4 to 6) with two types or more of different plate width (U, V, W, Z) in plate thickness direction, the recessed groove (11) or the protruding stripe (12) formed over entire length (K) in longitudinal direction of each of the horizontal members forms one of the alternative joints by a difference (D) provided between outer layer plate width (W. Z) of outer layer sawn plates (1, 3, 4, 6) interposing an intermediate layer from outer layers in the three laminated layers and an intermediate plate width (U, V) of intermediate sawn plate (2, 5) interposed as the intermediate layer, and further comprising eaves holders (43) or upper rails (41) formed to absorb the difference (D) of at least one side of the protruding stripe (12, 42) by covering the protruding stripe (12, 42).

The invention described in claim 2 is the construction (100) according to claim 1, wherein the horizontal members (10) compose each of the upper frame materials (19) and the lower frame materials (17, 18) by laminating three sawn plates (1 to 3, 4 to 6) with two types or more of different plate width (U, V, W, Z) in plate thickness direction, the recessed groove (11) or the protruding stripe (12) formed over entire length (K) in longitudinal direction of each of the horizontal members forms one of the alternative joints by a difference (D) provided between outer layer plate width (W, Z) of outer layer sawn plates (1, 3, 4, 6) interposing an intermediate layer from outer layers in the three laminated layers and an intermediate plate width (U, V) of intermediate sawn plate (2, 5) interposed as the intermediate layer, the vertical members (20) compose each of the pillar materials (29) or the framework walls (50) by laminating three sawn plates (23 to 25) in plate width direction, and each of the pillar materials (29) are formed with a protrusion (22) or a recess (21) at both ends (26, 27), which can be fitted closely to the recessed groove (11) or the protruding stripe (12), by deviating an intermediate sawn plate (24) in a longitudinal direction for a distance of the difference (D) with respect to outer layer sawn plates (23, 25) interposing the intermediate layer from the outer layers in the three laminated layers, in which all of sawn plates (23 to 25) to be laminated are having the same length (L).

In addition, the invention described in claim 3 is the construction (100) according to claim 1 or 2, wherein each of the lower frame materials (17, 18) are provided with the protruding stripe (12) directed upward, each of the pillar materials (29) are standing with its lower end (26) formed with the recess (21) directed downward and with its upper end (27) formed with the protrusion (22) directed upward, each of the pillar materials (29) can be self-stood by fitting the recess (21) of the pillar materials (29) to the protruding stripe (12) of the lower frame materials (17, 18), and the recessed groove (11) of each of the upper frame materials (19) can be constructed by closely fitting the recessed groove (11) of the upper frame materials (19) downwardly to the protrusion (22) of the self-standing pillar materials (29) from above.

In addition, the invention described in claim 4 is the construction (100) according to claim 2 or 3, wherein in three sawn plates (1 to 3, 4 to 6) with two types or more of different plate width (U, V, W, Z), 206 material with thickness of 38 mm and width of 140 mm, 208 material with same thickness and width of 184 mm, or 210 material with same thickness and width of 235 mm is used as plate material with wide plate width (V, W), and 204 material with thickness of 38 mm and width of 89 mm or 205 material with same thickness and width of 114 mm is used as plate material with narrow plate width (U, Z).

In addition, the invention described in claim 5 is the construction (100) according to any of claims 2 to 4, wherein a material composed in equivalent shape as the three sawn plates from solid wood, laminated wood, or laminated veneer lumber is used, instead of the three sawn plates (1 to 3, 4 to 6).

In addition, the invention described in claim 6 is a wooden construction (100) having structural materials for assembling by fitting horizontal members (10) and vertical members (20), comprising: side joists (40) with protruding stripe formed in one plate by surface joining a side joist (13) composing the horizontal members (10) and a back side joist (16) with plate width wider than the side joist (13) by difference (D) at back side of the side joist (13), in which upward protruding stripe (42) is formed in longitudinal direction by the difference (D); and pillar materials (29) for upper floor composing the vertical members (20) in which a recess (21) capable of fitting closely to the upward protruding stripe (42) at optional position in longitudinal direction of the upward protruding stripe (42) to be able to make the vertical members (20) self-stood is formed at bottom end (26), wherein further comprising eaves holders (43) or upper rails (41) formed to absorb the difference (D) of at least one side of the protruding stripe (12, 42) by covering the protruding stripe (12, 42).

In addition, the invention described in claim 7 is the construction (100) according to claim 2 or 6, wherein the difference (D) is formed by deviating the materials with same size.

In addition, the invention described in claim 9 is a construction method for assembling a wooden construction (100) having structural materials in which vertical members (20) composing pillar materials (29) or framework walls (50) are fitted to horizontal members (10) composing lower frame materials (17, 18) and upper frame materials (19) at construction site, comprising: an alternative joint forming step (S10) for previously forming alternative joints at fitting parts of the structural materials; and an assembly step (S20) for assembling the structural materials formed with the alternative joints, wherein the alternative joints for closely fitting the vertical members (20) to the horizontal members (10) at optional position in horizontal direction of the horizontal members (10) to be able to make the vertical members (20) self-stood are previously provided at fitting parts of the structural materials, wherein the alternative joint forming step (S10) comprising: a lower frame protruding stripe and upper frame recessed groove forming step (S11), in which three sawn plates (1 to 3, 4 to 6) with two types or more of different plate width (U, V, W, Z) are laminated in plate thickness direction in order to form one of the alternative joints over entire length (K) in longitudinal direction of each of the upper frame materials (19) and the lower frame materials (17, 18), for forming a recessed groove (11)

or a protruding stripe (12) formed in longitudinal direction by a difference (D) provided between an outer layer plate width (W, Z) of outer layer sawn plates (1, 3, 4, 6) interposing an intermediate layer from outer layers in three laminated layers and an intermediate plate width (U. V) of an intermediate sawn plate (2, 5) interposed as the intermediate layer, wherein eaves holders (43) or upper rails (41) formed to absorb the difference (D) of at least one side of the protruding stripe (12, 42) by covering the protruding stripe (12, 42) are used.

In addition, the invention described in claim 10 is the construction method according to claim 9, wherein the alternative joint forming step (S10) comprising: a lower frame protruding stripe and upper frame recessed groove forming step (S11), in which three sawn plates (1 to 3, 4 to 6) with two types or more of different plate width (U, V, W, Z) are laminated in plate thickness direction in order to form one of the alternative joints over entire length (K) in longitudinal direction of each of the upper frame materials (19) and the lower frame materials (17, 18), for forming a recessed groove (11) or a protruding stripe (12) formed in longitudinal direction by a difference (D) provided between an outer layer plate width (W, Z) of outer layer sawn plates (1, 3, 4, 6) interposing an intermediate layer from outer layers in three laminated layers and an intermediate plate width (U, V) of an intermediate sawn plate (2, 5) interposed as the intermediate layer; and a pillar material end recess and end protrusion forming step (S12), in which three sawn plates (23 to 25) in same length (L) are laminated in plate thickness direction in order to form the alternative joints at both ends (26, 27) of each of the pillar materials (29), for forming a recess (21) or a protrusion (22) capable of fitting closely to the protruding stripe (12) or the recessed groove (11) by deviating an intermediate sawn plate (24) in longitudinal direction for the difference (D) with respect to outer layer sawn plates (23, 25) interposing an intermediate layer from outer layers in three laminated layers, and wherein the assembly step (S20) comprising: a lower frame material arranging step (S21) for arranging the lower frame materials (17, 18); a pillar material self-standing fitting step (S22) for self-standing the pillar materials (29) by fitting the recess (21) formed at lower end (26) of each of the pillar materials (29) to the protruding stripe (12) of the lower frame materials (17, 18) arranged upward; and an upper frame material fitting step (S23) for fitting the upper frame materials (19) with downward recessed groove (11) to cover the above of the protrusion (22) formed at upper end (27) of each of the self-standing pillar materials (29).

In addition, the invention described in claim 11 is the construction method according to claim 10, wherein a material composed in equivalent shape as the three sawn plates from solid wood, laminated wood, or laminated veneer lumber is used, instead of the three sawn plates (1 to 3, 4 to 6).

In addition, the invention described in claim 12 is the construction method according to claim 10 or 11, wherein the difference (D) is formed by deviating the materials with same size.

According to the present invention, it is possible to provide a construction capable of completing framework in short period with few workers by making pillars, which are relatively lightweight and can be supported by one worker, self-stood independently at free position in horizontal direction of upper frames or lower frames, and by making the work to fit large and heavy panel by plural workers unnecessary at construction site. Further, it is possible to provide a construction to improve productivity by simplifying and omitting joint process according to inherent standing position of the pillars with respect to horizontal members.

BRIEF DESCRIPTION OF THE DRAWINGS

FIG. 1 is perspective views for explaining structural materials (hereinafter, referred to as "the structural materials") of a construction (hereinafter, referred to as "the construction") relating to one embodiment of the present invention, FIG. 1A illustrates a lower end of a pillar material, FIG. 1B illustrates lower frame materials, and FIG. 1C illustrates a state that the pillar materials are fitted to and self-stood on the lower frame material.

FIG. 2 is perspective views for explaining the structural materials.

FIG. 3 is perspective views for explaining alternative joints formed in the pillar material of the construction.

FIG. 4 is perspective views for explaining a horizontal member formed with alternative joint(s) in the construction.

FIG. 5 is views for schematically illustrating principal parts of the construction concretely.

FIG. 6 is perspective views for explaining the alternative joints of the structural materials.

FIG. 7 is perspective views for explaining the alternative joints of the structural materials.

FIG. 10 is perspective views illustrating a state that the process has been progressed from the state of FIG. 9.

FIG. 11 is perspective views for explaining an interim progress for achieving the state of FIG. 10B more simply, FIG. 11B illustrates a state like FIG. 10B, and FIG. 11C illustrates a state of viewing FIG. 11B from opposite direction.

FIG. 12 is perspective views illustrating that it is having an equivalent function with the configuration of FIG. 10B, even with the simplified configuration illustrated in FIG. 11.

DETAILED DESCRIPTION OF THE INVENTION

Figures 2A, 2B, 2C, 2D, 2E:
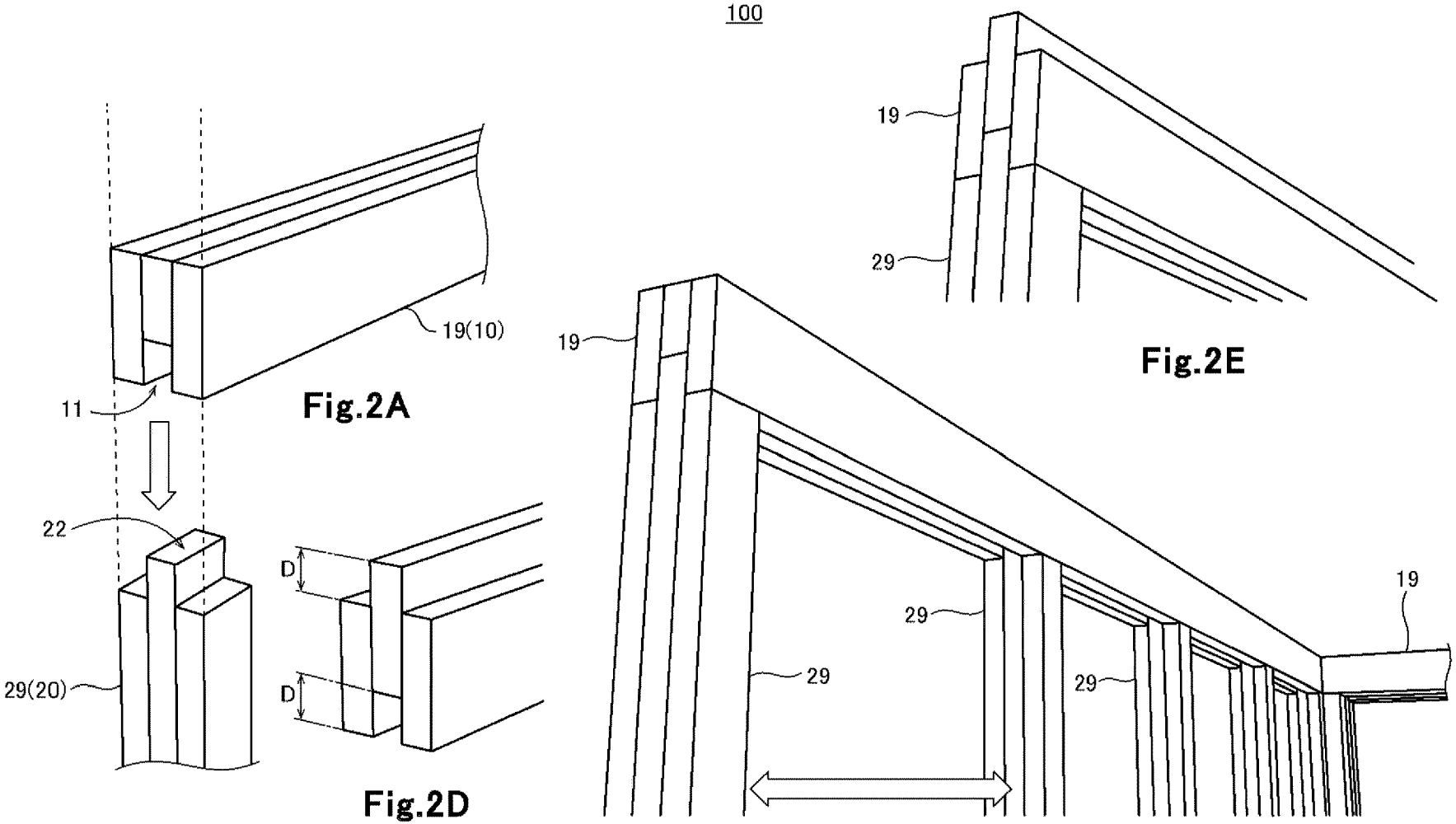
FIG. 2A illustrates an upper frame material.
FIG. 2B illustrates an upper end of the pillar material, FIG. 2 C illustrates a state that the upper frame materials are fitted to the pillar materials.
FIG. 2D illustrates a rail material formed with a difference by deviating the materials with same size.
FIG. 2E illustrates a state that the rail material is used for the upper frame material (upper rail).

A wooden framework construction method (hereinafter, referred to as "conventional construction method") is a traditional construction method in Japan, and it is a construction method for assembling by providing joints to precut pillars and beam materials, and by reinforcing with metal fittings. A wooden framework panel construction method (hereinafter, referred to as "IDS construction method") based on this construction method also belongs to a category of the conventional construction method basically. On the other hand, 2×4 construction method is a traditional construction method in North America, and it is having an advantage that high processing technique is not necessary, as standardized panels are assembled by metal fittings or nailing. In addition, wooden framework is assembled by structural materials.

As lumbers for 2×4 construction method, it is defined in JAS (Japanese Agricultural Standard), but woods with prescribed size specified by names below are used. In other words, 1×4 (19×89 for dried wood), 1×6, 2×2, 2×3, 2×4 (204 material), 2×5 (205 material), 2×6 (206 material), 2×8, 2×10 (210 material), 2×12, 4×4 (404 material), and 4×6 (406 material) with different sectional shape are used. In addition, the names are derived from inch size, but actual sizes are smaller than the named inch size.

Hereinafter, explaining about embodiments of the present invention by referring to the drawings. FIG. 1 is perspective views for explaining structural materials (hereinafter, referred to as "the structural materials") of a construction (hereinafter, referred to as "the construction") relating to one embodiment of the present invention, FIG. 1A illustrates a lower end of a pillar material, FIG. 1B illustrates lower frame materials, and FIG. 1C illustrates a state that the pillar materials are fitted to and self-stood on the lower frame material. The construction (100) is a wooden construction having the structural materials for assembling by fitting horizontal members 10 and vertical members 20.

FIG. 2 is perspective views for explaining the structural materials, FIG. 2A illustrates an upper frame material, FIG. 2B illustrates an upper end of the pillar material, FIG. 2 C illustrates a state that the upper frame materials are fitted to the pillar materials, FIG. 2D illustrates a rail material formed with a difference by deviating the materials with same size, and FIG. 2E illustrates a state that the rail material is used for the upper frame material (upper rail). As illustrated in FIG. 1 and FIG. 2, the construction 100 is having the structural materials at least comprising lower frame materials 18, pillar materials 29, and upper frame materials 19. In addition, the construction 100 is not always limited to 2×4 building by 2×4 construction method, but frequently uses the above lumbers for 2×4 construction method. The rail material illustrated in FIG. 2D is appropriate not only for the upper rail (upper frame material) 19 of FIG. 2E, but also for a ridgepole (upper rail) of FIG. 15 or upper rails (upper frame materials) of FIG. 15 (E) or FIG. 16E, and as illustrated in FIG. 4C, it can be composed, for example only by 208 materials. It goes without saying that it is not limited to 208 material.

Alternative joints are formed by deforming and generalizing joints to be formed previously at fitting parts of the structural materials composed of the horizontal members 10 and the vertical members 20. The horizontal members 10 mainly compose the upper frame materials 19 and the lower frame materials 18, and a recessed groove 11 or a protruding stripe 12 is formed over entire length in longitudinal direction of each of the horizontal members 10 as the alternative joint. The vertical members 20 composes the pillar materials 29 by forming the alternative joints at both ends in a shape capable of fitting closely to the recessed groove 11 or the protruding stripe 12.

Figure 3A:
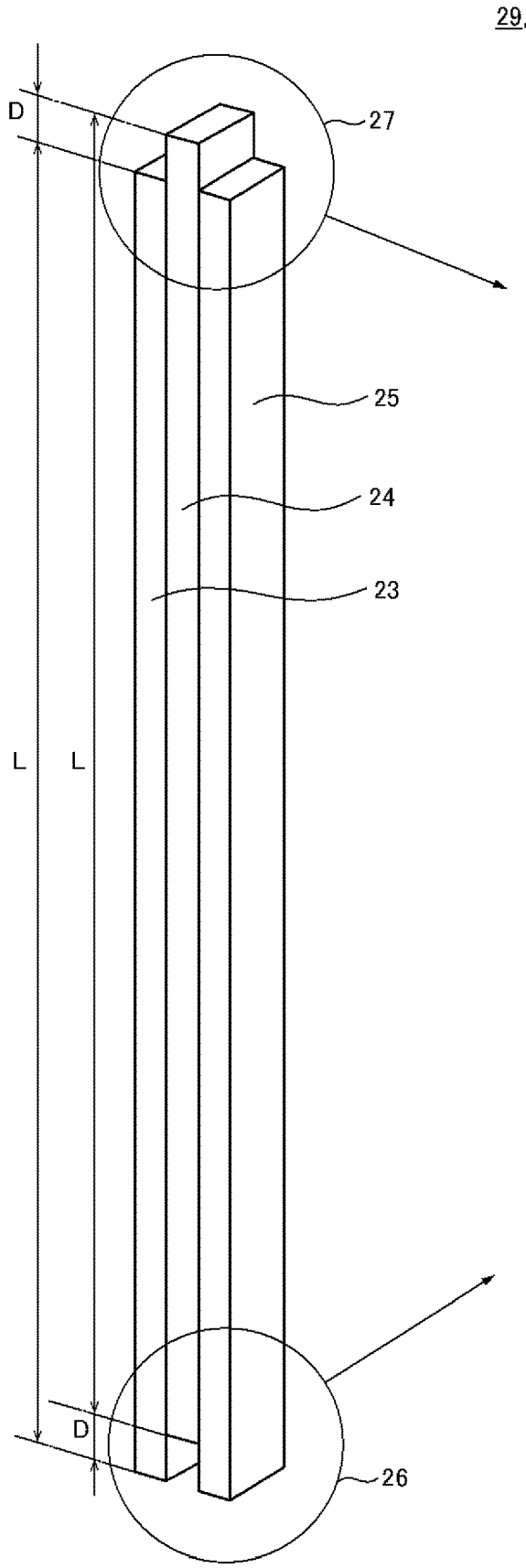
FIG. 3A illustrates entire pillar material.
Figure 3B:
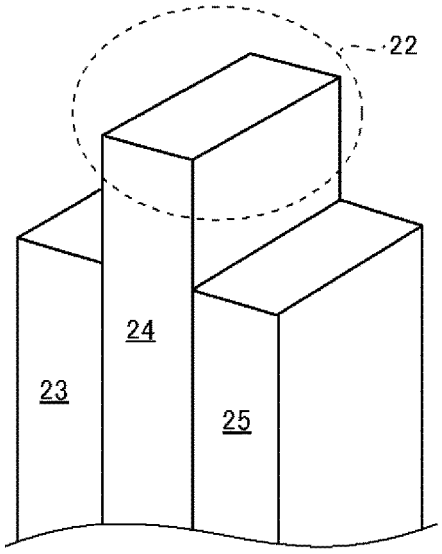
FIG. 3B illustrates the upper end.
Figure 3C:
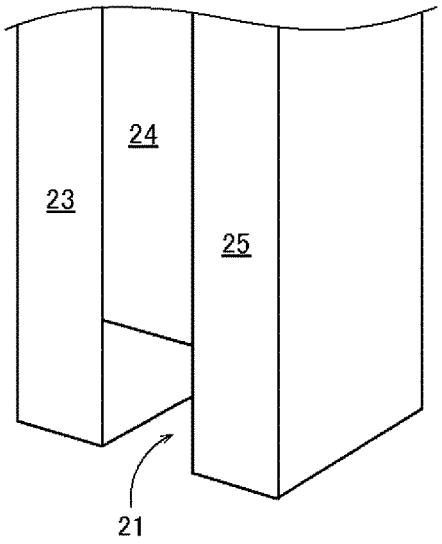
FIG. 3C illustrates the lower end.

FIG. 3 is perspective views for explaining alternative joints formed in the pillar material of the construction, FIG. 3A illustrates entire pillar material, FIG. 3B illustrates the upper end, and FIG. 3C illustrates the lower end. As illustrated in FIG. 3, in the vertical member 20, all of sawn plates to be laminated are having same length L. The vertical member 20 composes the pillar material 29 or a framework wall 50 (FIG. 5A) by laminating three sawn plates 23 to 25 in plate thickness direction. In addition, about the framework wall 50, it will be explained later. In addition, a material composed in equivalent shape as the three sawn plates from solid wood, laminated wood, or laminated veneer lumber may be used, instead of the three sawn plates 23 to 25. Hereinafter, same applies to the three sawn plates.

As mentioned above, the pillar material 29 is composed by laminating three sawn plates 23 to 25 all in same length L. A recess 21 is formed at lower end 26 of the pillar material 29. In addition, a protrusion 22 is formed at upper end 27 of the pillar material 29. These recess 21 and protrusion 22 are formed by deviating an intermediate sawn plate 24 in longitudinal direction for a difference D with respect to outer layer sawn plates 23, 25 interposing an intermediate layer from outer layers in three laminated layers.

The pillar material 29 maintains a state that the intermediate sawn plate 24 with the length L is deviated in longitudinal direction for the difference with respect to the outer layer sawn plates 23, 25 with the length L, and integrated as one by unillustrated nailing. This operation does not use glue, so it can be performed easily at construction site by non-skilled workers, and not in factory. As a result, in this pillar material 29, the protrusion 22 is formed at upper end 27 illustrated in FIG. 3B, and the recess 21 is formed at lower end 26 illustrated in FIG. 3C. These protrusion 22 and recess 21 form the alternative joints alternating the joints at upper end 27 and lower end 26 of the pillar material 29, i.e. main vertical member 20.

Figure 4A:
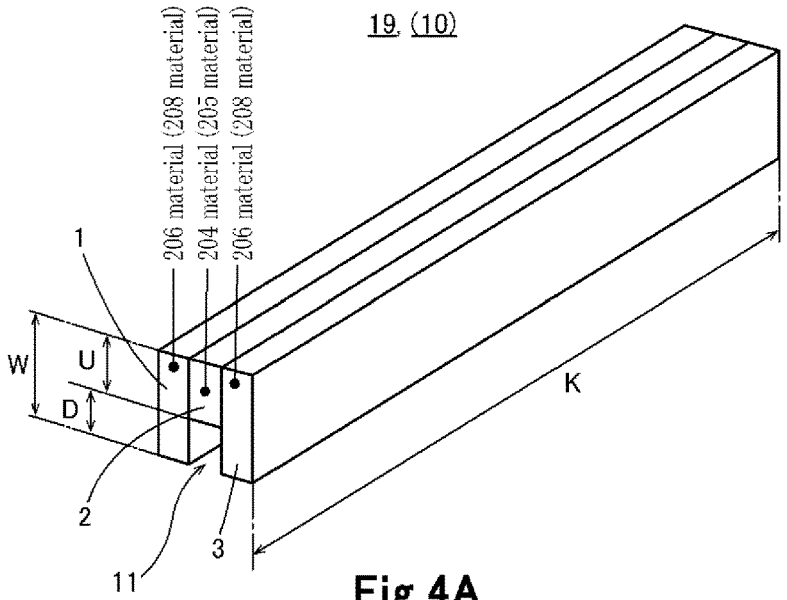
FIG. 4A illustrates the upper frame material.
Figure 4B:
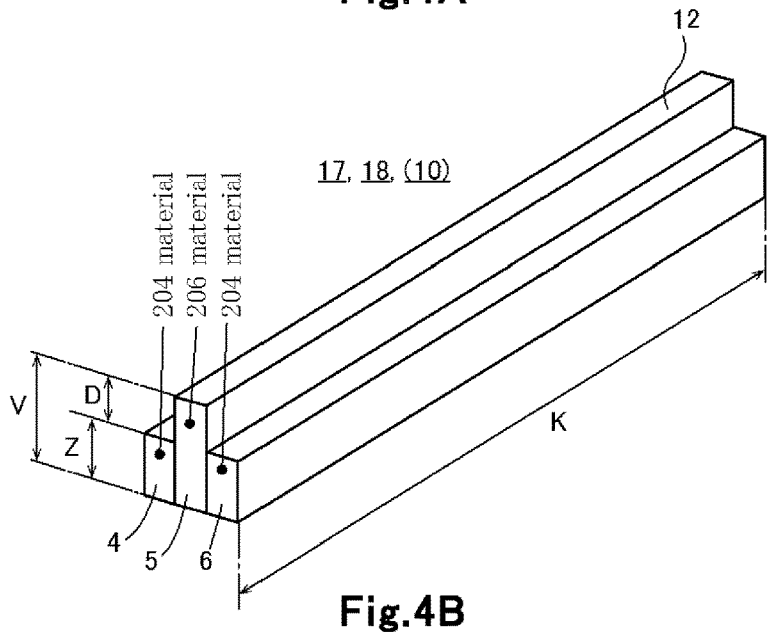
FIG. 4B illustrates the lower frame material.
Figure 4C:
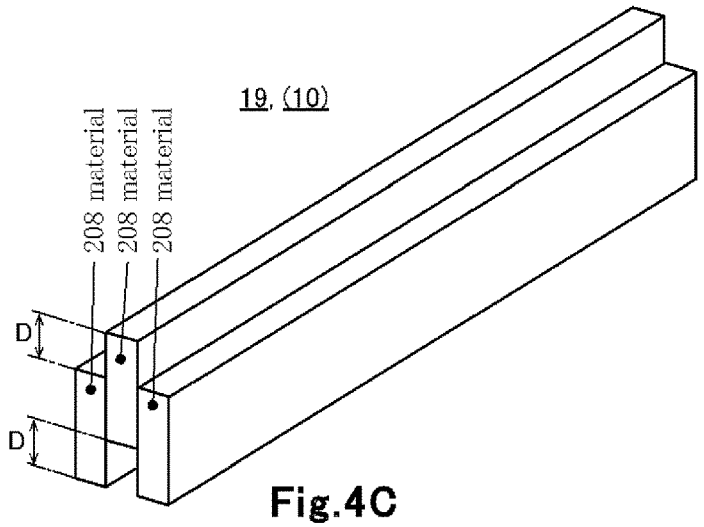
FIG. 4C illustrates a rail material formed with a difference by deviating the materials with same size.

FIG. 4 is perspective views for explaining a horizontal member formed with alternative joint(s) in the construction, FIG. 4A illustrates the upper frame material, FIG. 4B illustrates the lower frame material, and FIG. 4C illustrates a rail material formed with a difference by deviating the materials with same size. As illustrated in FIG. 4, the upper frame material 19 and the lower frame material 17, 18, which are main horizontal materials, are formed by laminating three sawn plates 1 to 3, 4 to 6 with two types or more of different plate width U, V, W, Z in plate thickness direction. In each of the upper frame material 19 and the lower frame material 17, 18 (FIG. 5A), the alternative joint is formed by the recessed groove 11 or the protruding stripe 12 formed over entire length K in longitudinal direction.

This recessed groove 11 or protruding stripe 12 is formed by a difference D provided between outer layer plate width W, Z of the outer layer sawn plates 1, 3, 4, 6 interposing the intermediate layer from the outer layers in the three laminated layers and an intermediate plate width U, V of the intermediate sawn plate 2, 5 interposed as the intermediate layer. This alternative joint generalizes and alleviates fitting condition of the joint, and also, the alternative joint is formed to fit the vertical member 20 closely to an optional position in horizontal direction of the horizontal member 10 to be able to make the vertical member 20 self-stood. In addition, the operation to integrate three laminated layers as one is performed by maintaining a state that the intermediate sawn plate 2, 5 and the outer layer sawn plates 1, 3, 4, 6 are deviated in plate thickness direction for the difference D, and by integrating as one by unillustrated nailing.

As illustrated in FIG. 4A, the upper frame material 19 is formed by laminating three sawn plates 1 to 3 in plate thickness direction and by integrating as one by unillustrated nailing. The difference D is provided between outer layer plate width W of the outer layer sawn plates 1, 3 and intermediate plate width U of the intermediate sawn plate 2. The recessed groove 11 is formed by this difference D. The upper frame material 19 is fitted to the protrusion 22 of the pillar material 29 from above with the recessed groove 11 directed downward.

As illustrated in FIG. 4B, the lower frame material 17, 18 is formed by laminating three sawn plates 4 to 6 in plate thickness direction and by integrating as one by unillustrated nailing. The difference D is provided between outer layer plate width Z of the outer layer sawn plates 4, 6 and intermediate plate width V of the intermediate sawn plate 5. The protruding stripe 12 is formed by this difference D. This lower frame material 18 is laid with the protruding stripe 12 directed upward. On the protruding stripe 12, the recess 21 of the pillar material 29 is fitted from above. The protrusion 22 or the recess 21 is configured to be fitted closely to an optional position in horizontal direction of the recessed groove 11 or the protruding stripe 12 of the horizontal member 10 to be able to make the vertical member 20 self-stood. As illustrated in FIG. 4C, it is possible to use a rail material forming the difference D by laminating and deviating 208 materials with same size in plate thickness direction, and by integrating as one by unillustrated nailing as the upper frame material (upper rail) 19, instead of the three sawn plates 4 to 6.

As mentioned above, the vertical member 20 composing the pillar material 29 illustrated in FIG. 3A is standing with its upper end 27 (FIG. 3B) formed with the protrusion 22 directed upward, and with its lower end 26 (FIG. 3C) formed with the recess 21 directed downward. In addition, the pillar material 29 can be self-stood by fitting the recess 21 (FIG. 1A) of the pillar material 29 closely to the protruding stripe 12 (FIG. 1B) of the lower frame material 18. The horizontal member 10 composing the upper frame material 19 illustrated in FIG. 4A is constructed with the recessed groove 11 directed downward. The upper frame material 19 can be self-stood by fitting the recessed groove 11 of the upper frame material 19 closely to the protrusions 22 of the pillar materials 29. As a result, it is possible to set up the framework easily with few workers, as the framework becomes stable only by fitting.

As illustrated in FIG. 4, in the construction 100, it is preferable to use 206 (2×6) material with thickness of 38 mm and width of 140 mm as the outer layer sawn plates 1, 3 and the intermediate sawn plate 5, and it is preferable to use 204 (2×4) material with thickness of 38 mm and width of 89 mm as the intermediate sawn plate 2 and the outer layer sawn plates 4, 6. In other words, in the horizontal member 10, it is preferable to use 206 material with thickness of 38 mm and width of 140 mm as plate material with wide plate width V, W, and it is preferable to use 204 material with thickness of 38 mm and width of 89 mm as plate material with narrow plate width U, Z, in combination of the outer layer sawn plates 1, 3, 4, 6 and the intermediate sawn plate 2, 5. Hereinafter, explaining about more concrete structure of the construction 100 and the construction method for constructing the same.

The construction method is a construction method for assembling structural materials comprising horizontal members 10 composed of at least lower frame materials 18 and upper frame materials 19 and vertical member 20 composed of pillar materials 29 at construction site. In the construction method, alternative joints deformed to generalize joints to be formed at fitting parts of the structural materials are formed previously. In the construction method, the alternative joints are having a shape capable of self-standing the horizontal members 10 and the vertical members 20 when they are fitted closely. In addition, the recess 21 and the protrusion 22 of the pillar material 29, the protruding stripe 12 of the lower frame material 17, 18, and the recessed groove 11 of the upper frame material 19 can be formed equivalently by processing one solid wood, laminated wood, or laminated veneer lumber by grooving or the like, and equivalent effect can be achieved.

Figure 5A:
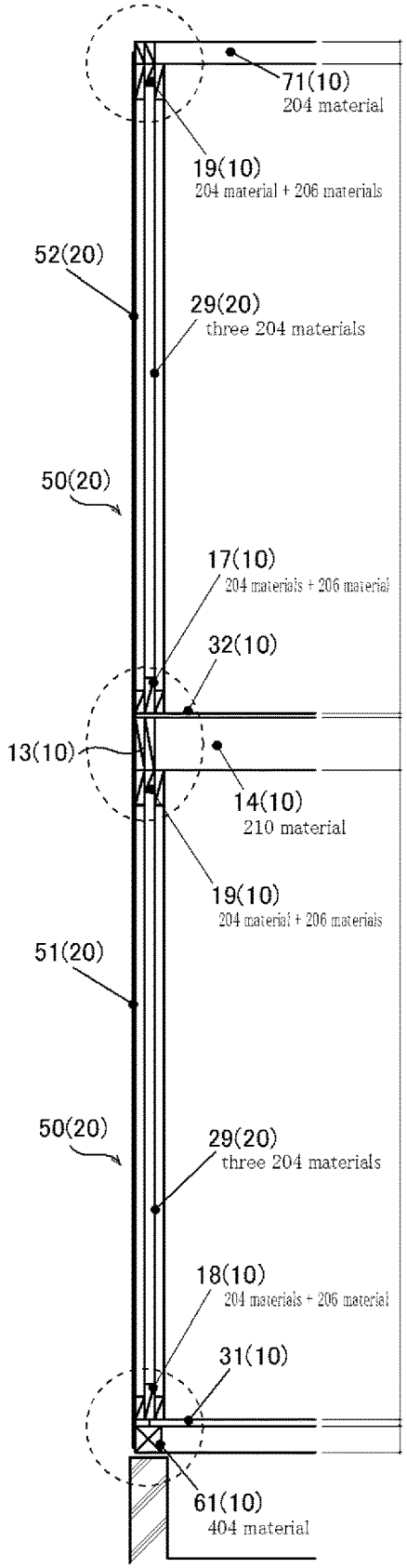
FIG. 5A is a front sectional view partially sectioning from a base to a roof frame of second floor about one wall surface of the construction.
Figure 5B:
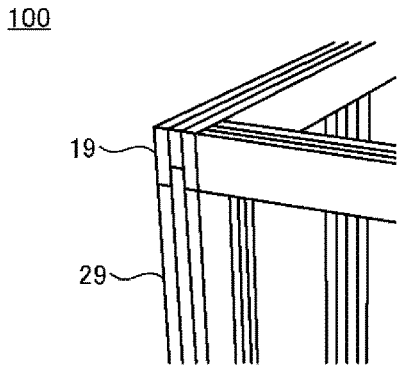
FIG. 5B is a perspective view illustrating the roof frame of second floor.
Figure 5C:
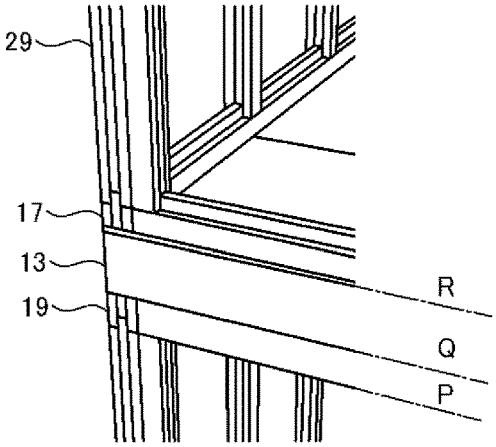
FIG. 5C is a perspective view illustrating a periphery of a floor joist.
Figure 5D:
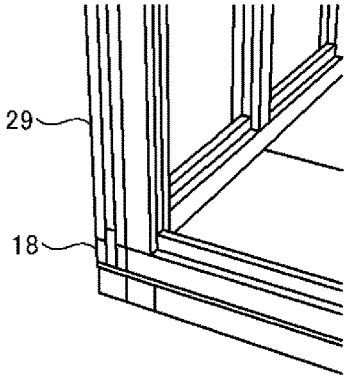
FIG. 5D is a perspective view illustrating a state that the pillar materials of first floor are assembled to the base.

FIG. 5 is views for schematically illustrating principal parts of the construction concretely, FIG. 5A is a front sectional view partially sectioning from a base to a roof frame of second floor about one wall surface of the construction, FIG. 5B is a perspective view illustrating the roof frame of second floor, FIG. 5C is a perspective view illustrating a periphery of a floor joist, FIG. 5D is a perspective view illustrating a state that the pillar materials of first floor are assembled to the base. As illustrated in FIG. 5, with respect to the base 61, the lower frame material 18, the upper frame material 19, the side joist 13, the floor joist 14, the lower frame material 17 of second floor, the pillar material 29 and the roof frame 71, the wooden framework of the construction 100 can be completed only by the structural materials according to lumbers for wooden wall frame construction method integrated to standard specification such as 204 material, 206 material, 210 material and 404 material, when the framework wall 50 is not used.

In addition, in a wall surface illustrated in FIG. 5A, a procedure for forming the wall surface by mounting outer wall plywoods 51, 52, after self-standing the pillar materials 29 one by one on the lower frame materials 17, 18 by fitting the pillar materials 29 closely to the lower frame materials 17, 18 by the alternative joints is illustrated, but it is not limited to this procedure. For example, as generalized by 2×4 construction method, if it is advantageous to use framework walls 50 previously assembled in panel shape in the factory, such framework walls may be used as illustrated in FIG. 5A. Also, in the framework wall 50, the alternative joints of the present invention can be applied.

In FIG. 5C, P layer is the upper frame material 19 of first floor, Q layer is the side joist 13 and the floor joist 14, and R layer is the lower frame material 17 of second floor. As illustrated in FIG. 5C, a boundary part from a ceiling of first floor to a floor of second floor is a structure illustrated by three layers of P, Q, R, and there is a room for consideration for simplification. About this point, it is described later that it can be simplified using FIGS. 10 to 13.

Figure 6C:
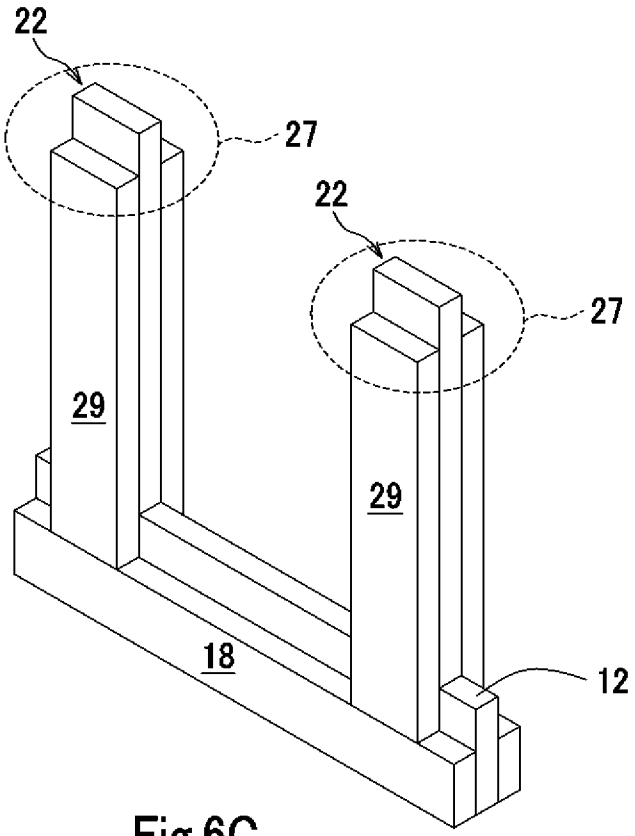
FIG. 6C illustrates a state that the pillar materials are fitted to and self-standing on the lower frame material.
Figure 6A:
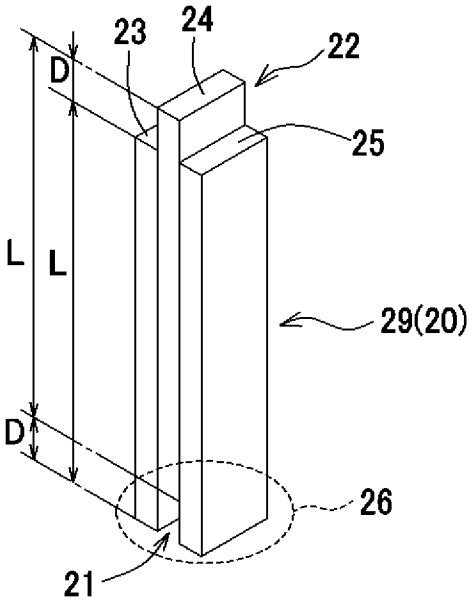
FIG. 6A illustrates the pillar material.
Figure 6B:
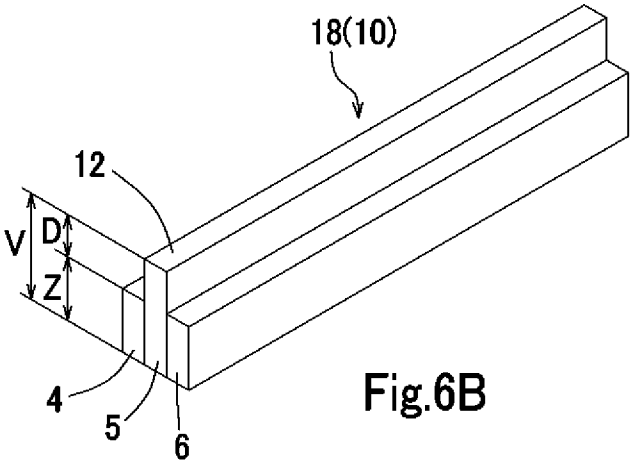
FIG. 6B illustrates the lower frame material formed with a protruding stripe.

FIG. 6 is perspective views for explaining the alternative joints of the structural materials, FIG. 6A illustrates the pillar material, FIG. 6B illustrates the lower frame material formed with a protruding stripe, and FIG. 6C illustrates a state that the pillar materials are fitted to and self-standing on the lower frame material. The alternative joints of the structural materials are configured to simplify processing and assembly by alternating the joints provided at the fitting parts of the structural materials in the conventional construction method, and also, to increase freedom of assembling position with respect to the horizontal direction. In addition, FIGS. 6 to 13 illustrate a model produced for experiment and its explanation, and its shape is different from actual building.

In other words, the recess 21 formed at lower end 26 of the pillar material 29 illustrated in FIG. 6A can be fitted to the protruding stripe 12 of the lower frame material 18 illustrated in FIG. 6B. Also, it can be fitted in same condition to an optional position in longitudinal direction of the protruding stripe 12 of the lower frame material 18 as illustrated in FIG. 6C. In other words, it would be adaptable to correspond to a window frame or a door by deviating a position of structural pillars accordingly instead of increasing (unillustrated) exclusive pillars. As a result, freedom of designing is increased and materials and man-hour can be reduced, and also, the work can be facilitated.

In other words, it is possible to provide the construction 100 with improved productivity by simplifying and omitting joint process according to inherent standing position of the pillars 29 with respect to the horizontal members 10. In addition, it is possible to complete the framework in short period with few workers by making only the pillars, which are relatively lightweight and can be supported by one worker, self-stood at free position in horizontal direction of upper frames 19 or lower frames (17), 18, and by making the work to fit large and heavy panel by plural workers unnecessary at construction site.

Figure 7B:
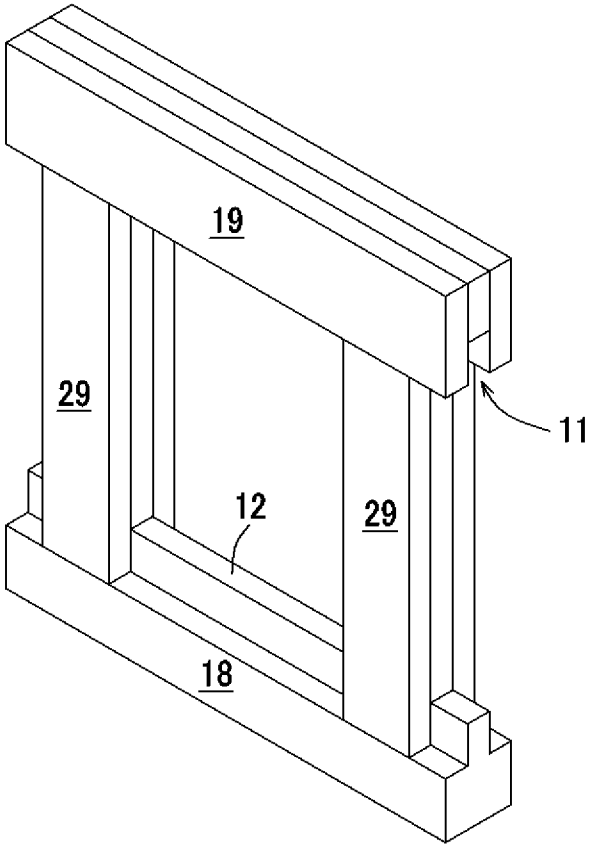
FIG. 7B illustrates a state that the upper frame material is fitted to the state of FIG. 6C.
Figure 7A:
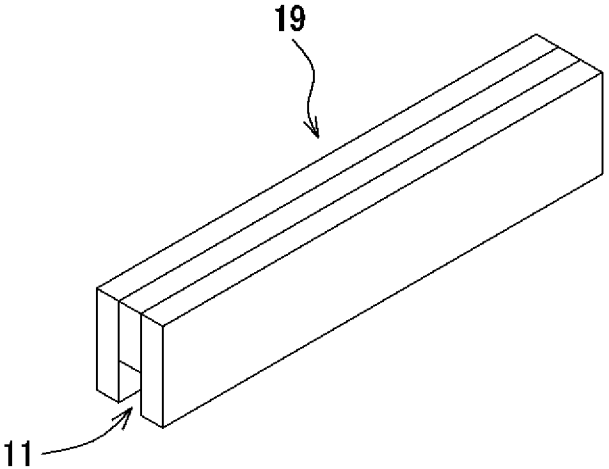
FIG. 7A illustrates the upper frame material formed with a recessed groove.

FIG. 7 is perspective views for explaining the alternative joints of the structural materials, FIG. 7A illustrates the upper frame material formed with a recessed groove, and FIG. 7B illustrates a state that the upper frame material is fitted to the state of FIG. 6C. The protrusions 22 formed at upper end 27 of the pillar materials 29 in a state of FIG. 6C can be fixed to the recessed groove 11 formed in the upper frame material 19 illustrated in FIG. 7A by fitting the protrusions 22 closely to an optional position in horizontal direction of the recessed groove 11. As a result, it would be adaptable to correspond, for example to existing door or standardized sash door in which size cannot be changed, by deviating a position of the structural pillars accordingly instead of increasing exclusive pillars.

Figure 8:
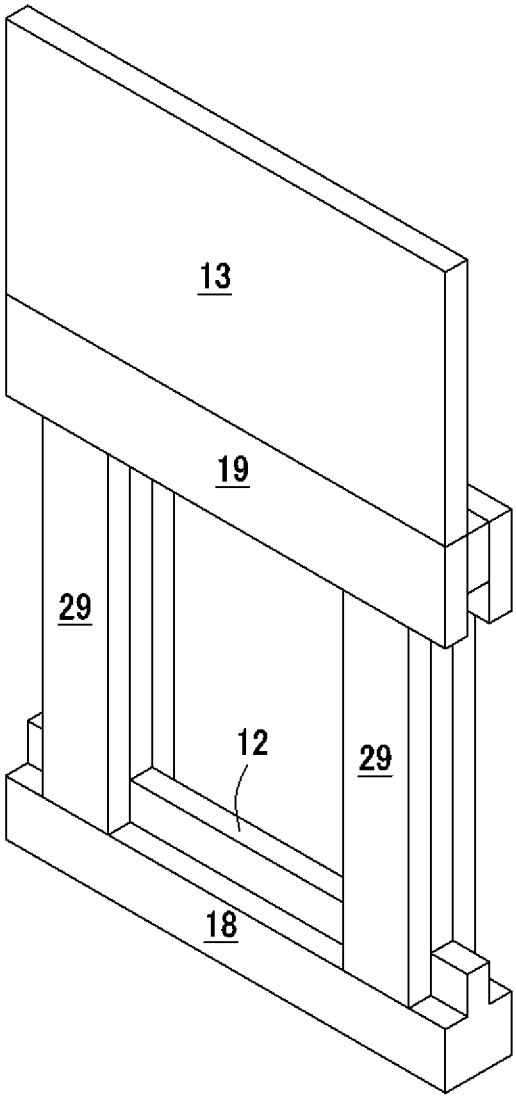
FIG. 8 is a perspective view for explaining a state that a side joist is provided to the state of FIG. 7B.

FIG. 8 is a perspective view for explaining a state that a side joist is provided to the state of FIG. 7B. The side joist 13 illustrated in FIG. 8 corresponds to the side joist 13 illustrated in FIG. 5.

Figure 9:
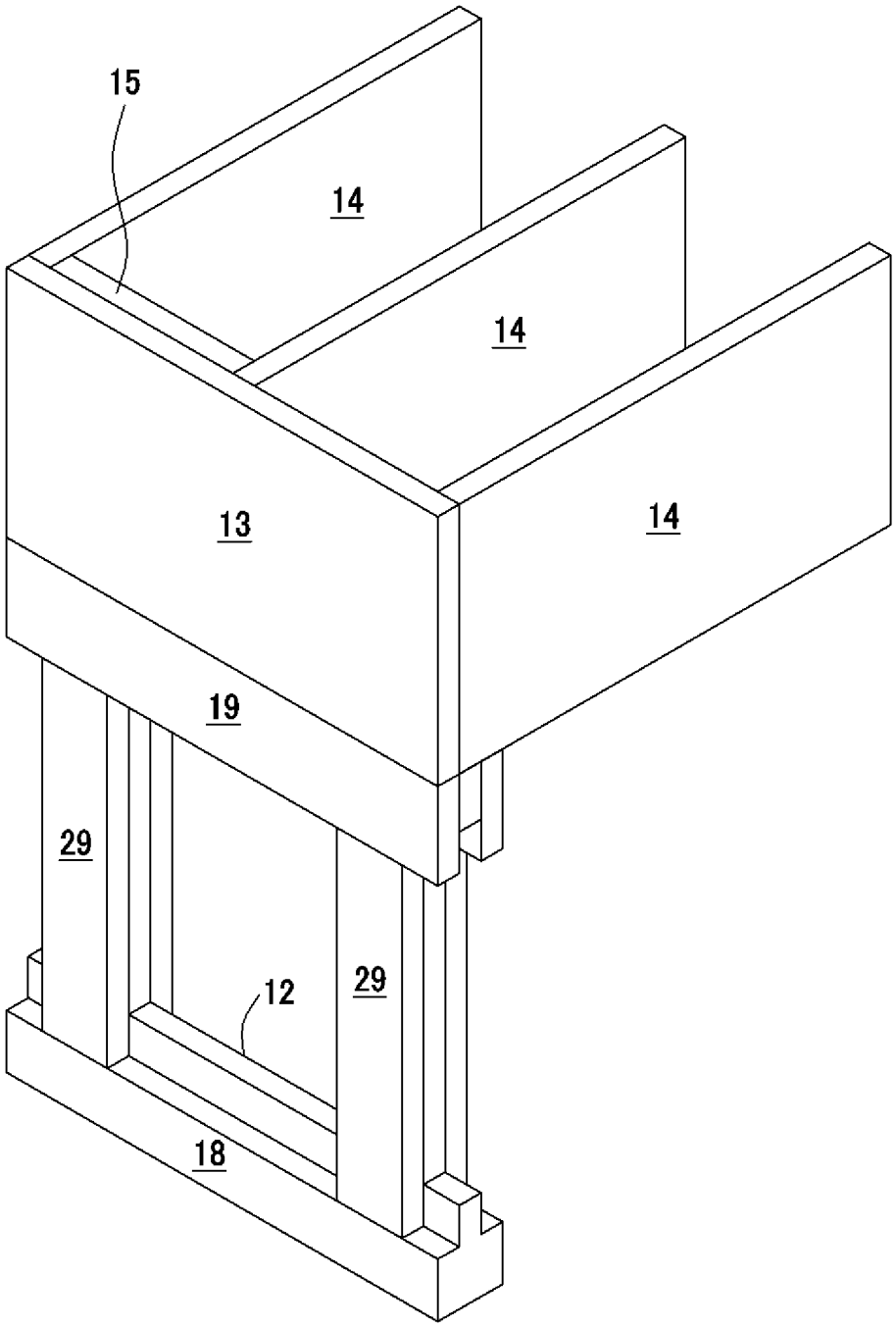
FIG. 9 is a perspective view for explaining a state that floor joists and a cleat are provided to the state of FIG. 8.

FIG. 9 is a perspective view for explaining a state that floor joists 14 and a cleat 15 are provided to the state of FIG. 8. The floor joists 14 illustrated in FIG. 9 correspond to the floor joist 14 illustrated in FIG. 5. The cleat 15 is having an effect of the cleat as it maintains to be vertical by regulating a spacing of the floor joists 14 plurally standing with the spacing. In addition, an effect for increasing structural strength can be obtained also by the cleat 15.

Figure 10B:
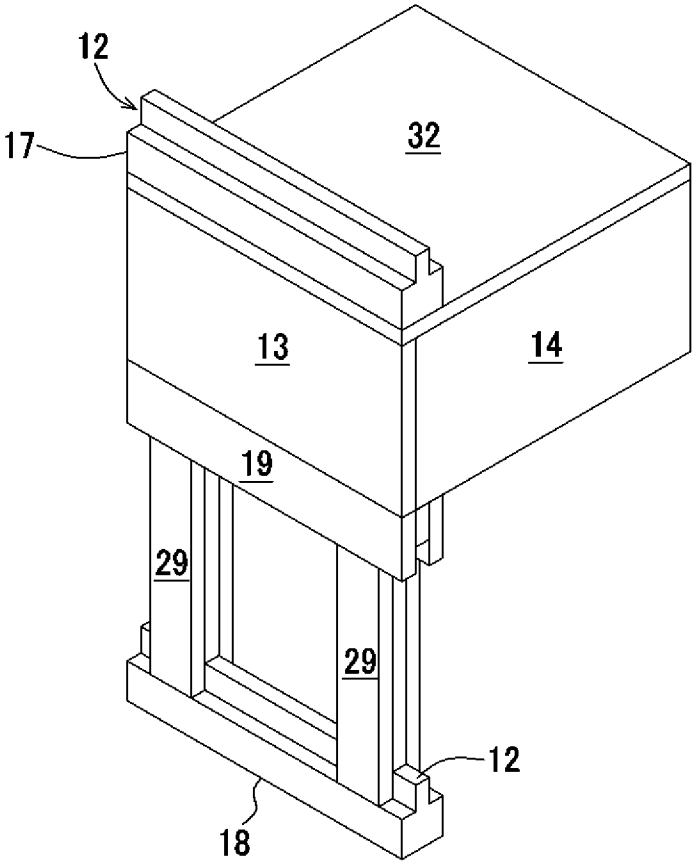
FIG. 10B illustrates a state that a lower frame material of second floor is laid.
Figure 10A:
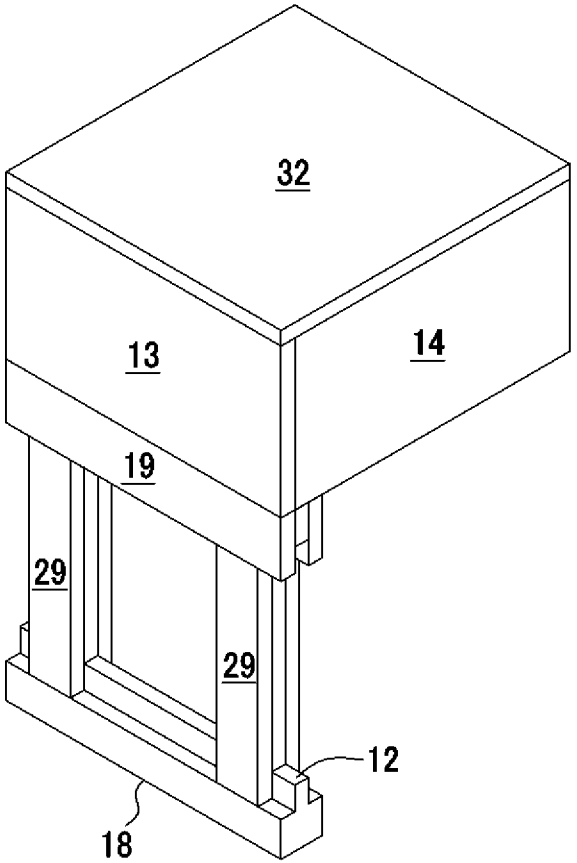
FIG. 10A illustrates a state that a floor plywood is laid.

FIG. 10 is perspective views illustrating a state that the process has been progressed from the state of FIG. 9, FIG. 10A illustrates a state that a floor plywood 32 is laid, and the floor plywood 32 illustrated in FIG. 10A corresponds to the floor plywood (structural plywood) 32 of second floor illustrated in FIG. 5. FIG. 10B illustrates a state that a lower frame material 17 of second floor is laid. The lower frame material 17 illustrated in FIG. 10B corresponds to the lower frame material 17 of second floor illustrated in FIG. 5.

Figures 11A, 11B, 11C:
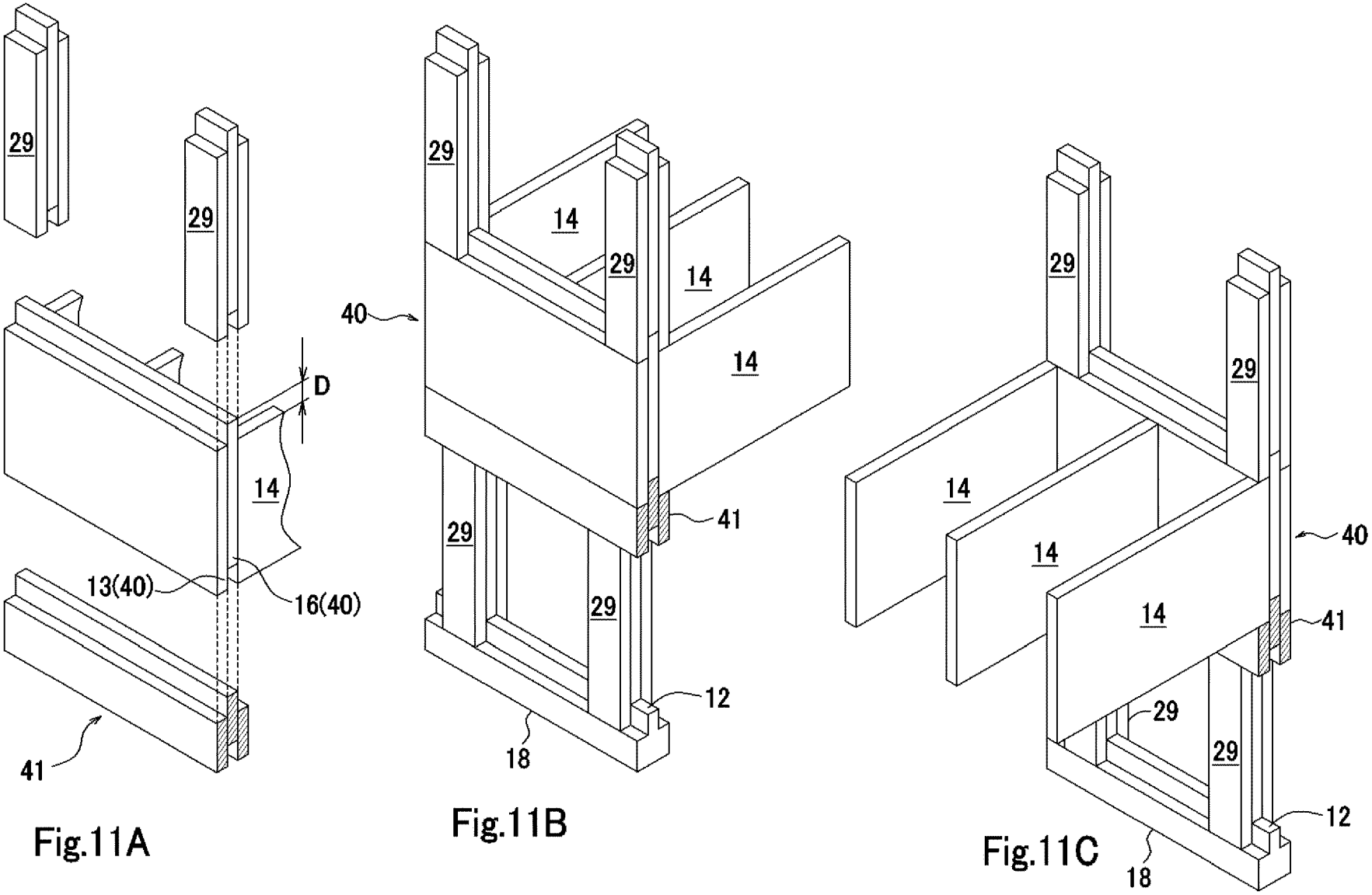
FIG. 11A illustrates a side joist with protruding stripe having a function integrating the side joist and the lower frame.
FIG. 11B and FIG. 11C illustrate a state that the pillar materials are stood on the side joist with protruding stripe.

FIG. 11 is perspective views for explaining an interim progress for achieving the state of FIG. 10B more simply, FIG. 11A illustrates a side joist with protruding stripe having a function integrating the side joist and the lower frame, FIG. 11B and FIG. 11C illustrate a state that the pillar materials are stood on the side joist with protruding stripe, and FIG. 11B illustrates a state like FIG. 10B, and FIG. 11C illustrates a state of viewing FIG. 11B from opposite direction. The side joist 40 with protruding stripe illustrated in FIG. 11A is formed as one plate by surface joining a back side joist 16 with plate width same as the side joist 13 and deviating for the difference D at back side of the side joist 13 by nailing. By this difference D, the upward protruding stripe 42 is formed in longitudinal direction as alternative joint. This alternative joint can also be formed easily by non-skilled worker at construction site, not in sawmilling factory for wooden wall frame construction method.

FIG. 11 illustrates that a state in which the protruding stripe 12 is formed upwardly by arranging the lower frame material 17 of second floor in FIG. 10B can be achieved more simply. In addition, at this stage, floor plywood 32 has not been laid.

Figure 12B:
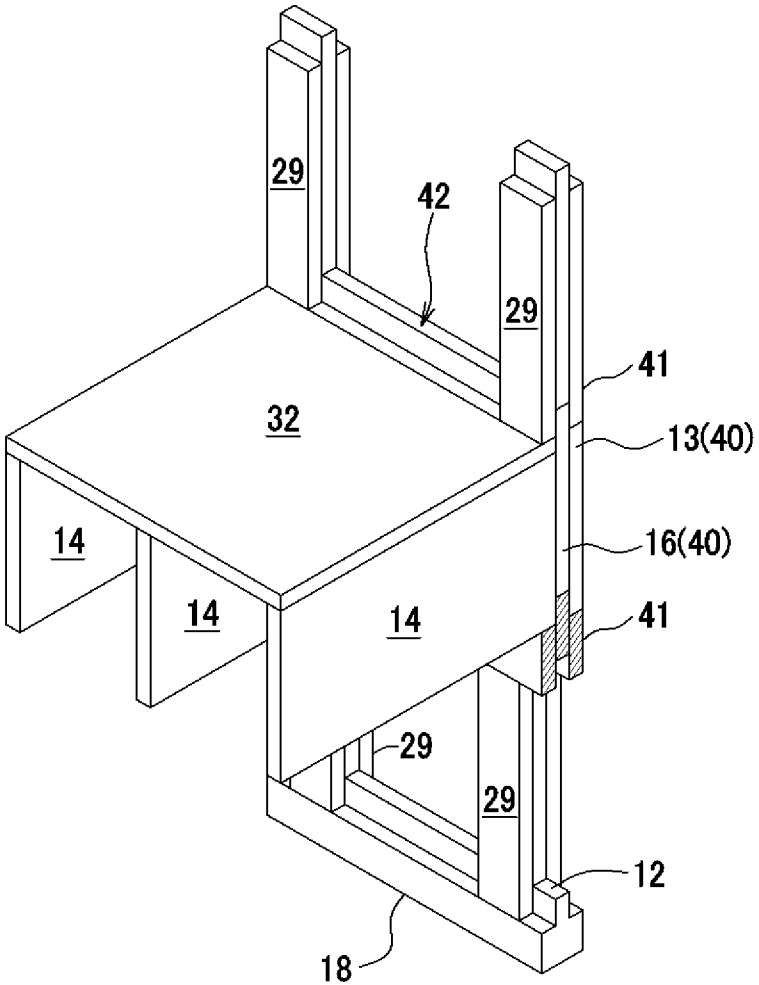
FIG. 12B illustrates a state of viewing FIG. 12A from opposite direction.
Figure 12A:
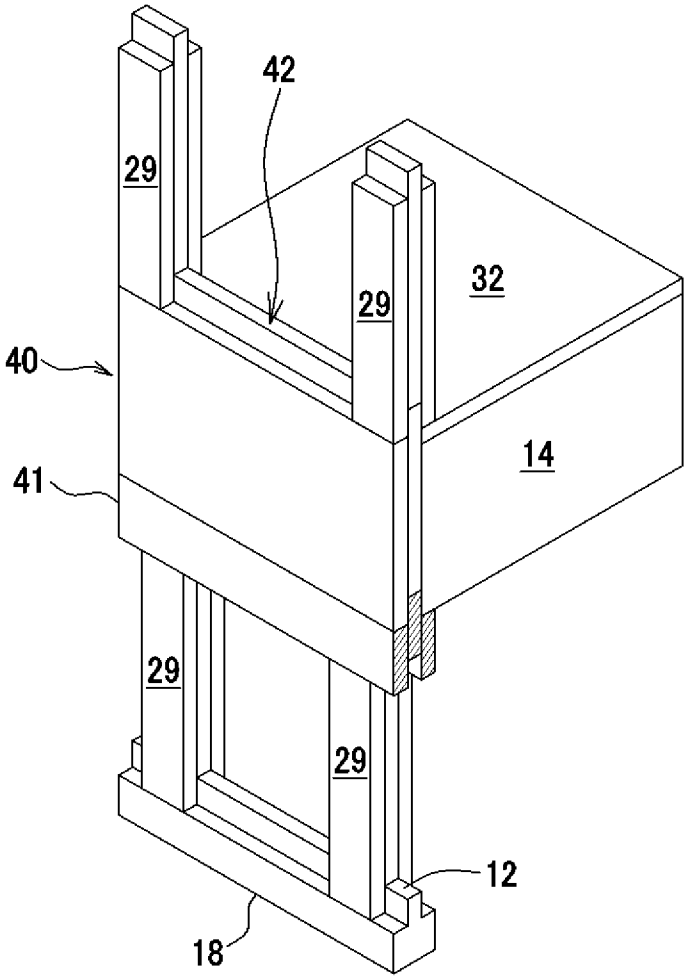
FIG. 12A illustrates a state that the floor plywood of second floor is laid and the pillar materials of second floor are mounted.

FIG. 12 is perspective views illustrating that it is having an equivalent function with the configuration of FIG. 10B, even with simplified configuration illustrated in FIG. 11, FIG. 12A illustrates a state that the floor plywood of second floor is laid and the pillar materials of second floor are mounted, and FIG. 12B illustrates a state of viewing FIG. 12A from opposite direction. FIG. 12 illustrates a state that the alternative joint having equivalent sectional shape with the protruding stripe 12 of FIG. 10B is formed, by completing the protruding stripe 42 by laying the floor plywood 32 of second floor, with respect to the state illustrated in FIGS. 11B and 11C.

Figure 13:
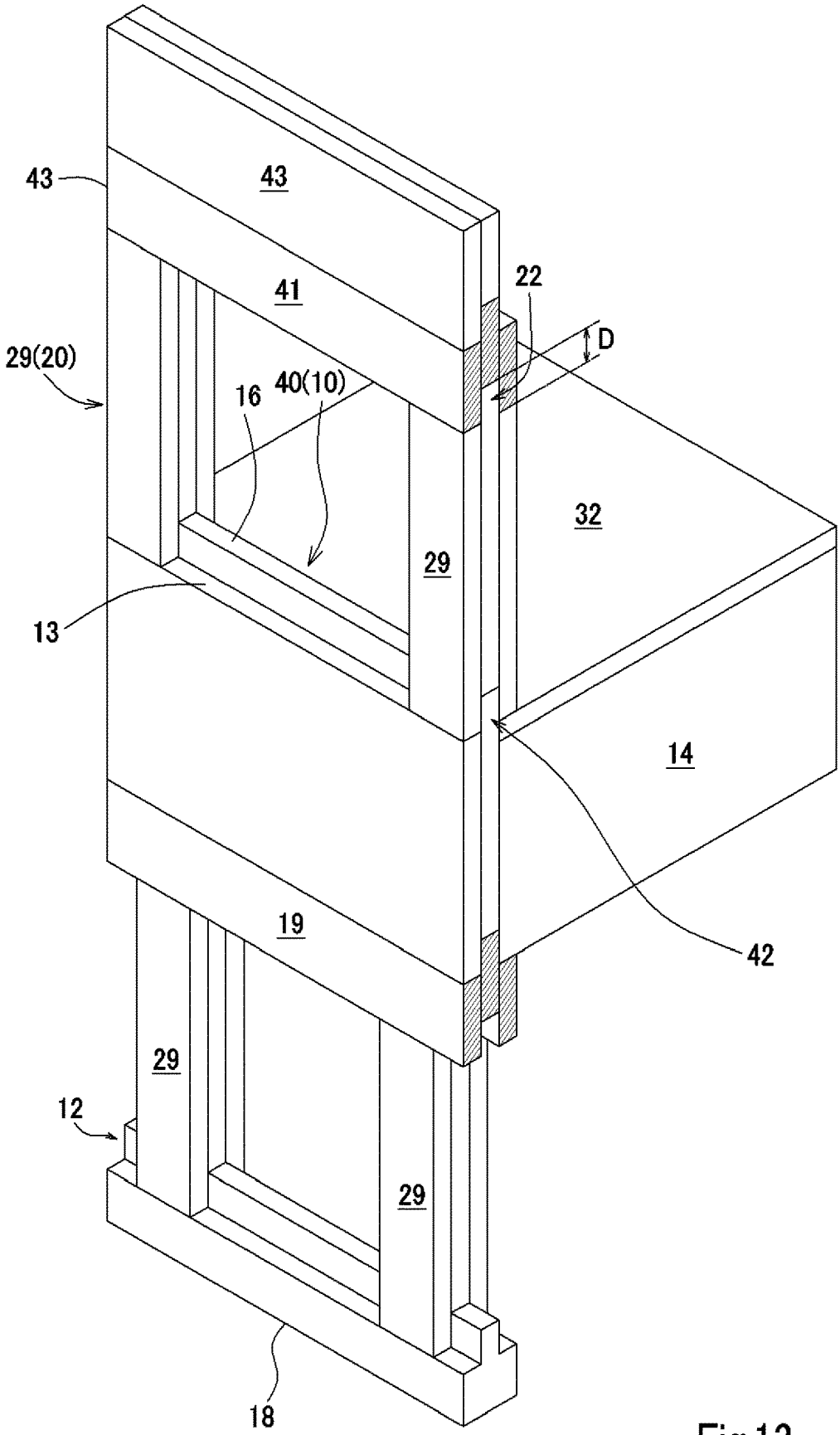
FIG. 13 is a perspective view illustrating a state that the process has been progressed from FIG. 12, and illustrating a state that the pillar materials, the upper rail and an eaves holder are mounted on the lower frame material of second floor.
Figure 15:
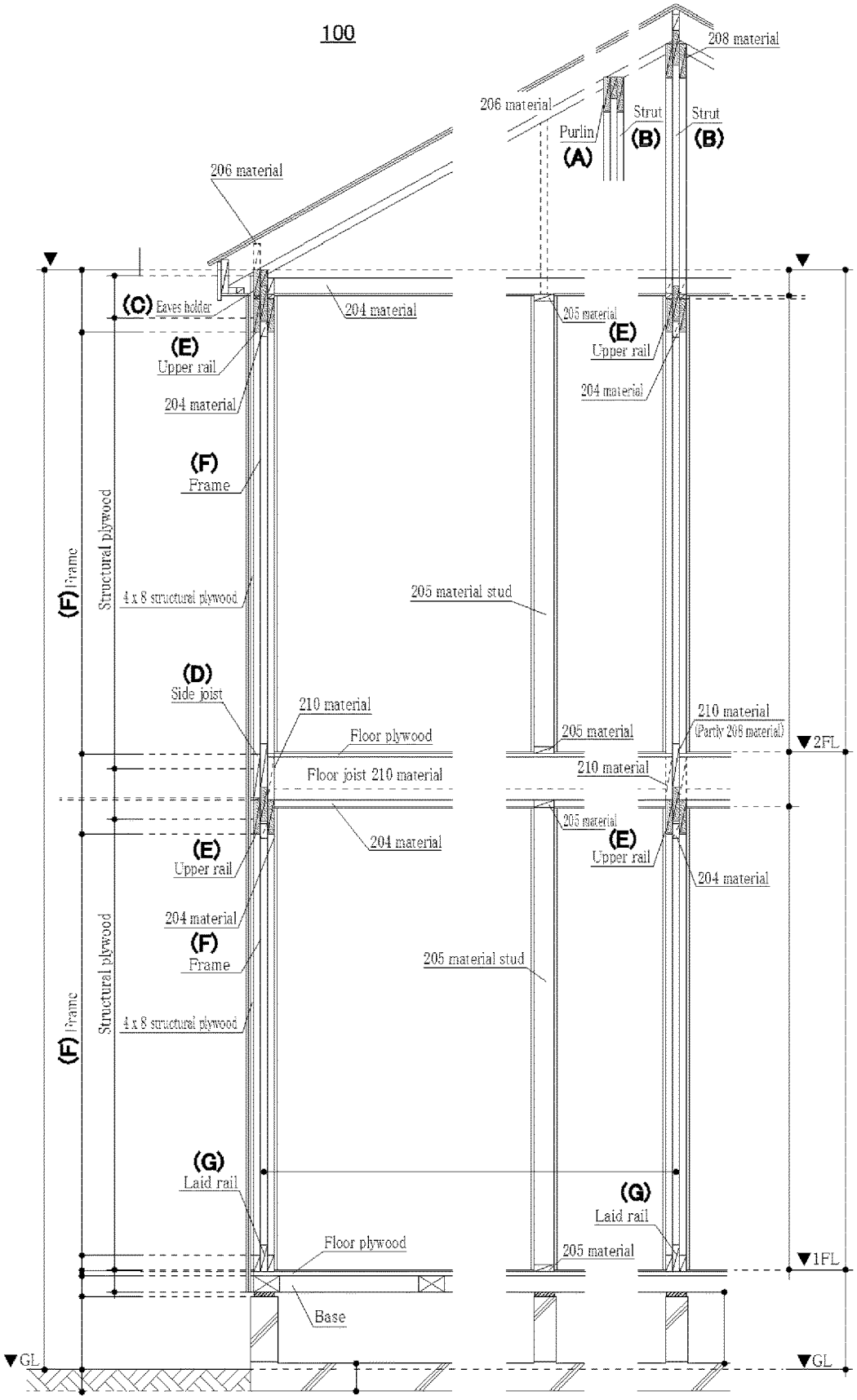
FIG. 15 is a rectangular diagram schematically adding and renewing principal parts of the construction illustrated in FIG. 5.

FIG. 13 is a perspective view illustrating a state that the process has been progressed from FIG. 12, and illustrating a state that the pillar materials, the upper rail and an eaves holder are mounted on the lower frame material of second floor. By covering and bridging the respective protrusions 22 formed upwardly in the pillar materials 29 of second floor by the eaves holder 43, the difference at one side of the protrusions 22 is absorbed, and flat area of a surface above the protrusions 22 will be increased. As illustrated in FIG. 15 (C), it will be stable when a rafter is laid on this flat area. As illustrated in FIG. 13, the pillar materials 29 of second floor can be fitted closely to an optional position in longitudinal direction of the protruding stripe 42 formed in the side joist 40 with the protruding stripe in equivalent condition. The effect of this feature is as mentioned above. With respect to this state illustrated in FIG. 13, a process of roof frame as illustrated in upper part of FIG. 5A and FIG. 5B is progressed and the framework (frame) will be completed. In addition, 2×4 material is also applied to the horizontal members 10 of the roof frame 71.

The wooden construction 100 illustrated in FIG. 13 is configured to have upper floor equal to or more than second floor by the structural materials assembled by fitting the horizontal members 10 and the vertical members 20. It comprises the side joists 40 with protruding stripe as the horizontal members 10 used for a connection of first floor and second floor, and it comprises the pillar materials 29 as the vertical members 20 of second floor. When the building is having three-stories, it can be applied similarly at a connection of second floor and third floor. In addition, the side joist 40 with protruding stripe can be formed equivalently by cutting and processing one solid wood, and equivalent effect can be achieved.

Also, in the pillar materials 29 of FIG. 13, the recess 21 formed at lower end 26 of the pillar material 29 can be fitted closely to an optional position in longitudinal direction of the upward protruding stripe 42 of the side joist 40 with protruding stripe to be able to make the pillar material self-stood, and its structure is same as the pillar material 29 of FIG. 3. As the above, in the fitting parts of the structural materials of the construction 100, the alternative joints are formed to generalize and alleviate fitting condition of joints to be formed previously before assembly. As the above, it is possible to complete the framework easily with few workers, as the structural materials can be self-stood only by fitting the alternative joints when assembling the framework.

As explained in the above, according to the construction relating to the present invention, it is possible to complete the framework in short period with few workers by making pillars, which are relatively lightweight and can be supported by one worker, self-stood independently at free position in horizontal direction of upper frames or lower frames, and by making the work to fit large and heavy panel by plural workers unnecessary at construction site.

In conventional wooden framework panel (IDS) construction method, it is necessary to self-stand the pillar materials 29 only by the framework. Therefore, joints were formed at fitting parts of the structural materials, and closely fitting state was formed by combining these joints, and self-standing state was maintained. As conventional IDS construction method, in the construction 100, the entire process is progressed in order of mounting wall surface 51, 52 (FIG. 5A) after assembling the frame (framework) previously.

Figure 14:
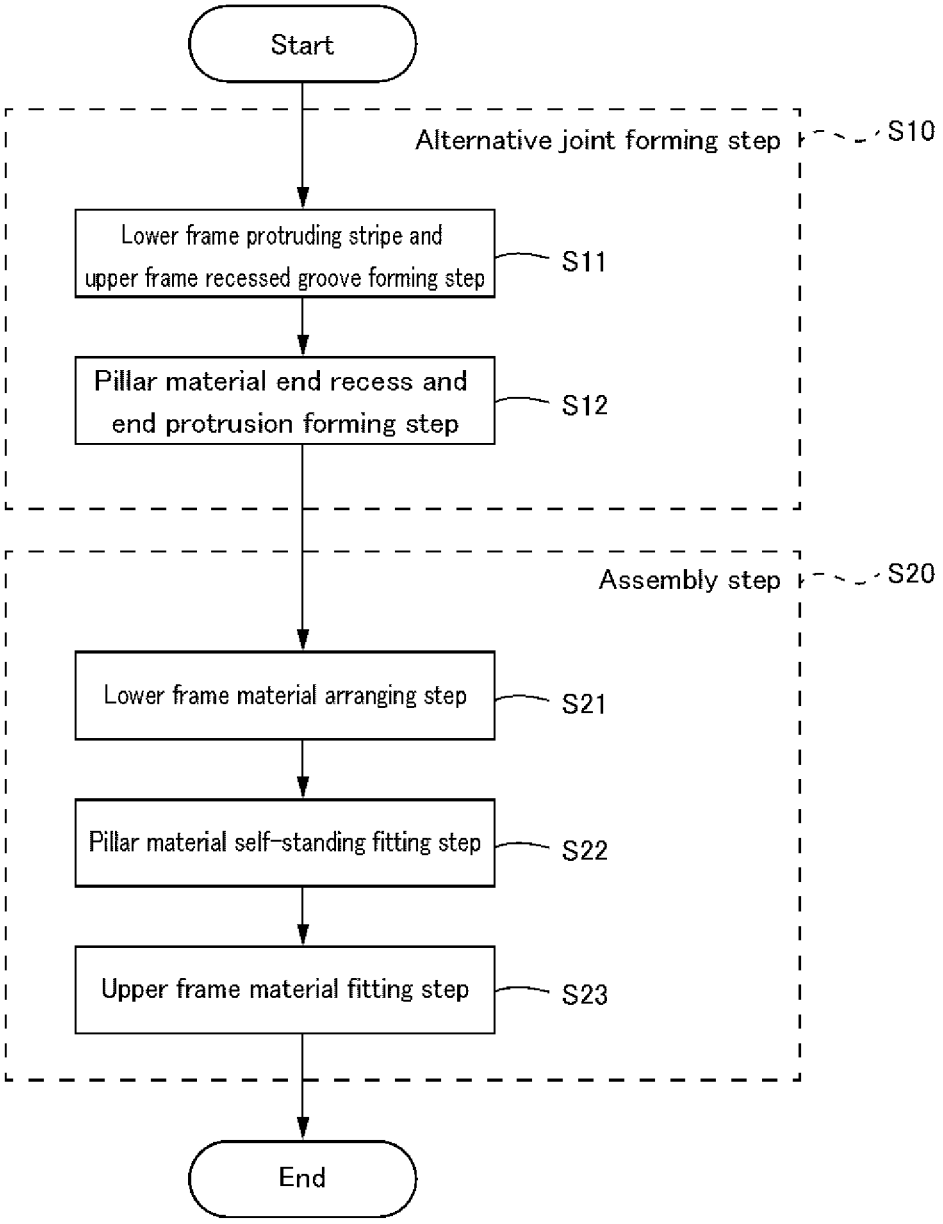
FIG. 14 is a flow chart for explaining principal parts of a construction method (hereinafter, referred to as "the construction method") relating to one embodiment of the present invention.

Hereinafter, explaining in more detail about the construction method using FIG. 14. FIG. 14 is a flow chart for explaining principal parts of the construction method. As illustrated in FIG. 14, the construction method comprises an alternative joint forming step (S10) and an assembly step (S20). In the alternative joint forming step (S10), the alternative joints are formed previously at fitting parts of the structural materials. In addition, in the assembly step (S20), the structural materials formed with the alternative joints are assembled.

The construction method is a construction method for constructing the wooden construction 100 by assembling these structural materials at construction site to fit the horizontal members 10 to the vertical members 20. The horizontal members 10 are composed of the lower frame material 17, 18, the upper frame material 19, the side joist 13, the floor joist 14, the floor plywood (structural plywood) 31, 32 and the side joist 40 with protruding stripe. The vertical members 20 are composed of the pillar material 29 and the outer wall plywood (structural plywood) 51, 52 or the framework wall 50.

The alternative joints are formed previously at fitting parts of the structural materials before assembly. These alternative joints are formed by deforming and generalizing the joints to be formed previously at fitting parts of the structural materials. In other words, the alternative joints generalize and alleviate fitting condition of the joints, and also, the alternative joints are formed to fit the vertical members 20 closely to an optional position in horizontal direction of the horizontal members 10 to be able to make the vertical members 20 self-stood. However, the alternative joints can be formed easily by non-skilled worker at construction site, not in sawmilling factory for wooden wall frame construction method.

In the alternative joint forming step (S10), three sawn plates 1 to 3, 4 to 6 with two or more types of different plate width U, V, W, Z are laminated in plate thickness direction, in order to form the alternative joint over entire length K in longitudinal direction of the upper frame material 19 or the lower frame material 17, 18. This alternative joint forming step (S10) further comprises a lower frame protruding stripe and upper frame recessed groove forming step (S11) and a pillar material end recess and end protrusion forming step (S12).

In the lower frame protruding stripe and upper frame recessed groove forming step (S11), the recessed groove 11 or the protruding stripe 12 extending in longitudinal direction is formed by the difference D provided between the outer layer plate width W, Z of the outer layer sawn plates 1, 3, 4, 6 interposing the intermediate layer from outer layers in three laminated layers and the intermediate plate width U, V of the intermediate sawn plate 2, 5 interposed by the outer layers as the intermediate layer. The recessed groove 11 or the protruding stripe 12 is formed as the alternative joint over entire length K in longitudinal direction of the horizontal member 10.

In the pillar material end recess and end protrusion forming step (S12), the alternative joints are formed at both ends 26, 27 of the pillar material 29. Therefore, three sawn plates 23 to 25 with same length L are laminated in plate thickness direction to be one member. The protrusion 22 and the recess 21 are formed as the alternative joints by deviating the intermediate sawn plate 24 for the difference D in longitudinal direction with respect to the outer layer sawn plates 23, 25 interposing the intermediate layer from the outer layers in the three laminated layers. The protrusion 22 formed at upper end 27 of the pillar material 29 can be fitted closely to the recessed groove 11. The recess 21 formed at lower end 26 of the pillar material 29 can be fitted closely to the protruding stripe 12 to make the pillar material 29 self-stood.

The assembly step (S20) further comprises a lower frame material arranging step (S21), a pillar material self-standing fitting step (S22), and an upper frame material fitting step (S23). In the lower frame material arranging step (S21), the lower frame materials 18 are arranged on the floor plywood 31 laid on the base 61 in the first floor part. In the second floor part, the lower frame materials 17 are formed on the floor plywood 32 laid on the side joist 13 and the floor joist 14. In the pillar material self-standing fitting step (S22), the recess 21 formed at lower end 26 of each of the pillar material 29 is fitted to the alternative joint of the protruding stripe 12 of the lower frame materials 17, 18 arranged upwardly to make the pillar materials 29 self-stood. In the upper frame material fitting step (S23), the upper frame materials 19 with the alternative joint of the downward recessed groove 11 is fitted to the protrusion 22 formed at upper end 27 of each of the self-stood pillar materials 29 to cover the above of the protrusions 22.

As explained in the above, according to the construction method relating to the present invention, the recess 21 formed at lower end 26 of each of the pillar materials 29 can be fitted closely to the protruding stripe 12 of the lower frame materials 17, 18 to make the pillar materials 29 self-stood. Further, the protrusion 22 formed at upper end 27 of each of the pillar material 29 can be fitted closely to the recessed groove 11 of the upper frame materials 19. Therefore, it is possible to set up the framework easily with few workers, as the framework can be fixed without becoming unstable only by fitting these alternative joints. In other words, it is having an effect to be able to complete the framework in short period with few workers by making pillars, which are relatively lightweight and can be supported by one worker, self-stood independently at free position in horizontal direction of upper frames or lower frames. As a result, it is having an effect to make the work to fit large and heavy panel by plural workers unnecessary at construction site.

Next, disclosing about frame materials described with latest sizes, in order to facilitate an adoption in many areas all over the world, using FIGS. 15 and 16. FIG. 15 is a rectangular diagram schematically adding and renewing principal parts of the construction illustrated in FIG. 5. FIG. 16 is outline drawings of frame materials to be used in the principal parts illustrated by (A) to (G) in FIG. 15, FIG. 16A illustrates a purlin (also called as upper rail, but different from FIG. 16E), FIG. 16B illustrates a strut, FIG. 16C illustrates the eaves holder, FIG. 16D illustrates the side joist, FIG. 16E illustrates the upper rail, FIG. 16F illustrates a frame (vertical member, pillar), and FIG. 16G illustrates a laid rail.

About each 2×4 material illustrated in FIG. 16, section size of 204 material, 205 material, 206 material, 208 material and 210 material are specified respectively. Partially overlapping descriptions are not avoided, but 204 material is having a thickness of 38 mm and a width of 89 mm (C, F, G of FIGS. 15 and 16 respectively), 205 material is having a thickness of 38 mm and a width of 114 mm (A, B of FIGS. 15 and 16 respectively), 206 material is having a thickness of 38 mm and a width of 140 mm (C, G of FIGS. 15 and 16 respectively), 208 material is having a thickness of 38 mm and a width of 184 mm (A, E of FIGS. 15 and 16 respectively), 210 material is having a thickness of 38 mm and a width of 235 mm (D of FIGS. 15 and 16 respectively), and unillustrated 212 material is having a thickness of 38 mm and a width of 286 mm.

Figure 16A:
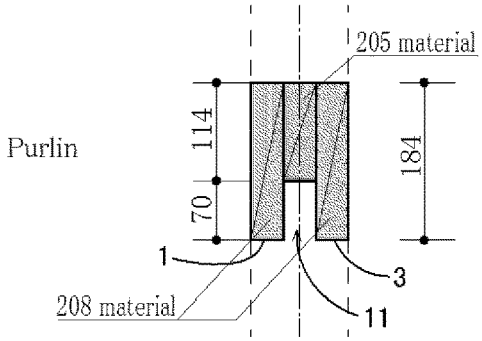
FIG. 16A illustrates a purlin (upper rail)

In addition, about each frame material disclosed using FIGS. 15 and 16, there are elaborated points with features as below. The recessed groove 11 of the purlin (upper rail, upper frame material, horizontal member) of FIG. 16A is having a depth of 70 mm, but a height of the protrusion 22 of the strut (pillar, vertical member) of FIG. 16B to be fitted to this recessed groove 11 is 66 mm, and there is an excess space of 4 mm even when the protrusion 22 is fitted entirely into the recessed groove 11. By this excess space of 4 mm, it becomes easy to make small revision by cutting only the outer layer sawn plates 23, 25 accordingly, when the purlin (upper rail) is bent and deviation is occurred.

In addition, not only the deviation occurred by bending of the purlin (upper rail), but also, there is a case that height of the protrusion 22, which should be 66 mm, could be higher to the extent of 69 mm as aligning position of three sawn plates is deviated to the extent of 3 mm. Also, in this case, the recessed groove 11 is set to a depth of about 70 mm with excess space, so that the higher protrusion 22 can be fitted in entirely. As a result, it is possible to achieve the effect to be able to fit the protrusion 22 smoothly without cutting off the protrusion 22, which is important for maintaining the structure even if it is too high, and also, the effect to be able to inhibit a defect to occur deviation to finishing of the building.

Figure 16E:
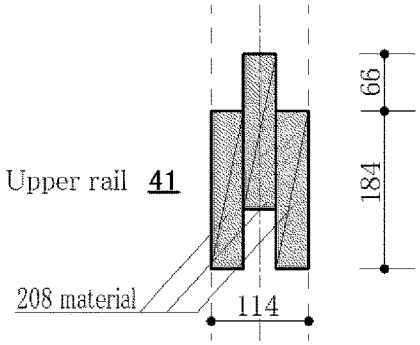
FIG. 16E illustrates the upper rail.
Figure 16B:
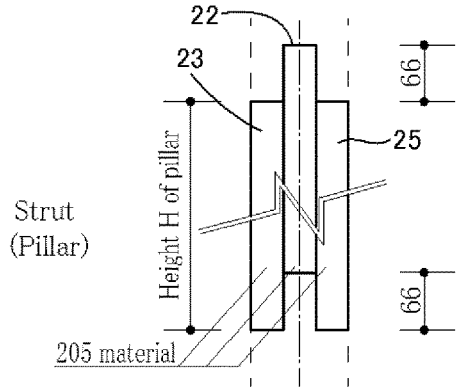
FIG. 16B illustrates a strut.
Figure 16F:
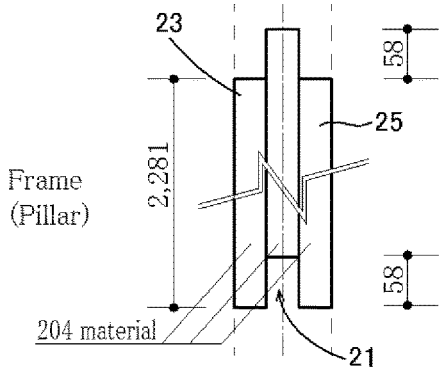
FIG. 16F illustrates a frame, and FIG. 16 G illustrates a laid rail.
Figure 16C:
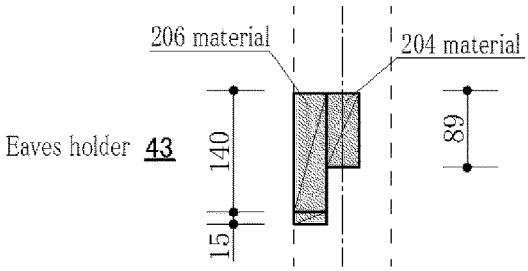
FIG. 16C illustrates the eaves holder.
Figure 16G:
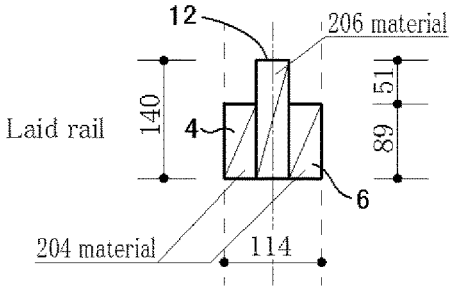
FIG. 16 is outline drawings of frame materials to be used in the principal parts illustrated by (A) to (G) in FIG. 15.
FIG. 16D illustrates the side joist.

Same has been considered also to the fitting parts of the laid rail of FIG. 16G and the frame (vertical member, pillar) 20 of FIG. 16F. In other words, a height of the protruding stripe 12 in the laid rail of FIG. 16G is 51 mm, but a depth of the recess 21 in the frame (vertical member, pillar) 20 of FIG. 16F to be fitted over this protruding stripe 12 is 58 mm, so there is an excess space of 7 mm even after receiving the entire protruding stripe 12 of the laid rail. By this excess space of 7 mm, it becomes easy to make small revision by cutting only the outer layer sawn plates 23, 25 accordingly, when the laid rail is bent and deviation is occurred.

In addition, not only that the laid rail may be bent and deviation may be occurred, but also that there is a case that aligning position of three sawn plates is deviated for about 6 mm, and a depth of the recessed groove 21, which should be 58 mm, will be shallow as about 52 mm. A target depth of the recessed groove 21 is set to about 58 mm with excess space, so that it would be possible to receive the entire protruding stripe with height of 51 mm, also in that case. As a result, it is possible to achieve the effect to be able to fit the protruding stripe 12 smoothly without adjustment to cut off the entire protruding stripe 12 which is important for maintaining the structure even when bending or deviation occurs, and also, the effect to be able to inhibit a defect to occur deviation to finishing of the building.

Next, explaining about the effect of covering the upper rail 41 of FIG. 16E with the eaves holder 43 of FIG. 16C. The upper frame material 19 of FIG. 2 is in a shape of pillar with flat upper surface, and it will be stable when a rafter is laid on such horizontal member 10. However, when the rafter is laid on the upper rail of FIG. 16E in which upper side is formed as protruding stripe, a stress that the weight of the rafter and the roof pushes and bends the protruding stripe to a direction of a ridgepole works and it will be unstable.

It is preferable to adjust component forces of load only to pushing down direction by lowering this pushing and bending stress. Here, by covering the upper side of the upper rail 41 of FIG. 16E formed as the protruding stripe by the eaves holder 43 of FIG. 16C, the weight of the rafter and the roof will be worked on the protruding stripe via the eaves holder. By covering the protruding stripe with the eaves holder, it will be close to a shape of pillar with flat upper surface, as the upper frame material 19 illustrated in FIG. 2.

Concerning the weight of the rafter and the roof loaded to the upper side of the upper rail formed in a shape of pillar with flat upper surface, the component forces of the load will be adjusted only to pushing down direction. As a result, a stress to push and bend the protruding stripe of the upper rail to a direction of the ridgepole will be decreased significantly, so the structure to support the rafter and the roof will be more stable. In other words, when the upper rail 41 of FIG. 16E is covered by the eaves holder 43 of FIG. 16C, it is possible to achieve the effect that the structure to support the rafter and the roof will be more stable.

Figure 16D:
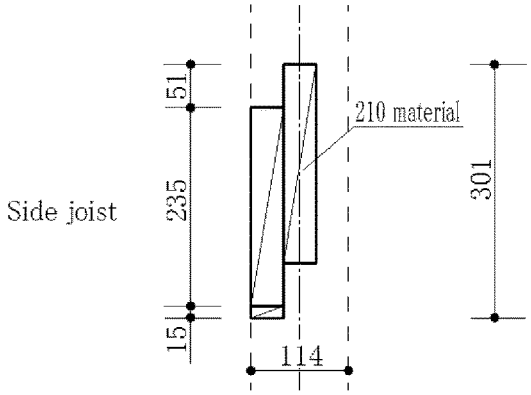

In addition, about a function of the side joist 13 in second floor part, it is as illustrated in FIGS. 5, 8, 9 and 11 to 13. In contrast, the side joist illustrated in (D) of FIG. 15 and FIG. 16D is having the effect that it can be fastened by nail firmly only by covering the upper rail 41 of FIG. 16E having the protruding stripe.

As disclosed using FIGS. 15 and 16, it is possible to facilitate to adopt the construction and the construction method relating to the present invention legally in many regions around the world with different laws, by using more various types of 2×4 materials.

The construction and the construction method of the present invention can be adopted to 2×4 buildings and other buildings and to the construction method thereof.

GLOSSARY OF DRAWING REFERENCES

1, 3, 4, 6, 23, 25 Outer layer sawn plates
2, 5, 24 Intermediate sawn plate
10 Horizontal member
11 Recessed groove
12, 42 Protruding stripe
13 Side joist
14 Floor joist
15 Cleat
16 Back side joist
17 Lower frame material (of second floor)
18 Lower frame material
19 Upper frame material
20 Vertical member
21 Recess of (of vertical member 20)
22 Protrusion (of vertical member 20)
26 Lower end (of pillar material 29)
27 Upper end (of pillar material 29)
29 Pillar material
31, 32 Floor plywood (structural plywood)
40 Side joist with protruding stripe
41 Upper rail
43 Eaves holder
50 Framework wall
51, 52 Outer wall plywood (structural plywood)
61 Base
71 Roof frame
100 Construction
D Difference
K Entire length (in longitudinal direction)
L Length (of sawn plates composing vertical member 20)
P, Q, R Structure illustrated by three layers
S10 Alternative joint forming step
S11 Lower frame protruding stripe and upper frame recessed groove forming step
S12 Pillar material end recess and end protrusion forming step
S20 Assembly step
S21 Lower frame material arranging step
S22 Pillar material self-standing fitting step
S23 Upper frame material fitting step
U, V Intermediate plate width
W, Z Outer layer plate width

The invention claimed is:

1. A wooden construction having structural materials for assembling by joining horizontal members and vertical members at a plurality of alternative joints such that the vertical members are self-standing, the wooden construction comprising:

an upper frame and a lower frame formed by the horizontal members, the upper frame and the lower frame including a recessed groove or a protruding stripe extending across an entire length in a longitudinal direction of each of the horizontal members so as to form an alternative joint of the plurality of alternative joints, the horizontal members being formed from three horizontal sawn plates that are laminated and have different plate widths in a plate width direction such that the recessed groove or the protruding stripe is formed by a difference between an outer layer plate width of outer layer sawn plates of the three horizontal sawn plates interposing an intermediate layer of the three horizontal sawn plates and an intermediate plate width of an intermediate sawn plate of the three horizontal sawn plates;

a plurality of pillars or framework walls formed by the vertical members, each pillar of the plurality of pillars including a protrusion at a first vertical end and a recess at a second vertical end opposite to the first vertical end, the protrusion being configured to be fitted to the recessed groove, and the recess being configured to be fitted to the protruding stripe, with the proviso that each pillar with the protrusion at the first vertical end and the recess at the second vertical end is formed by laminating three vertical sawn plates of a same length and an identical material, in a plate thickness direction; and an eaves holder or an upper rail including two or more boards configured to cover at least one side of the protruding stripe by covering the difference between the outer layer plate width of the outer layer sawn plates of the three horizontal sawn plates and the intermediate plate width of the intermediate sawn plate of the three horizontal sawn plates.

2. The wooden construction according to claim 1, wherein the protrusion or the recess of each pillar of the plurality of pillars is configured to be fitted closely to the recessed groove or the protruding stripe of the horizontal members by deviating an intermediate sawn plate of the three vertical sawn plates in a vertical direction at a distance corresponding to the difference between the outer layer plate width of the outer layer sawn plates of the three horizontal sawn plates and the intermediate plate width of the intermediate sawn plate of the three horizontal sawn plates.

3. The wooden construction according to claim 2, further comprising floor joists, wherein:

outer layer sawn plates of the upper frame have a thickness of 38 mm and a width of 140 mm or 184 mm, the floor joists have a thickness of 38 mm and a width of 235 mm, and outer layer sawn plates of the lower frame and an intermediate plate of the upper frame have a thickness of 38 mm and a width of 89 mm or 114 mm.

4. The wooden construction according to claim 2, wherein the three horizontal sawn plates and the three vertical sawn plates are composed of solid wood, laminated wood, or laminated veneer lumber.

5. The wooden construction according to claim 1, wherein:

the protruding stripe of the lower frame is directed upward, each pillar of the plurality of pillars stands with the recess formed at the second vertical end, which is a lower end of the respective pillar and being directed downward, and with the protrusion formed at the first vertical end, which is an upper end of the respective pillar and being directed upward, each pillar of the plurality of pillars is configured to be self-stood by joining the recess of the respective pillar to the protruding stripe of the lower frame, and the recessed groove of the upper frame being configured to be assembled to the plurality of pillars by fitting the recessed groove of the upper frame downwardly to the protrusion of a respective self-standing pillar of the plurality of pillars.

6. A wooden construction having structural materials for assembly by joining a plurality of horizontal members and a plurality of vertical members, the wooden construction comprising:

a plurality of joists forming the plurality of horizontal members, each joist of the plurality of joists including a protruding stripe formed in a plate by a surface joining a side joist of the plurality of joists and a back side joist of the plurality of joists, the back side joist having a plate width wider than a plate width of the side joist and being disposed at a back side of the side joist such that the protruding stripe protrudes upward by a difference of the plate width of the back side joist and the plate width of the side joist, and the back side joist is formed along a longitudinal direction;

a plurality of pillars forming the vertical members and including a protrusion at an upper end and a recess at a lower end opposite to the upper end of each pillar of the plurality of pillars, the protrusion being configured to be fitted to the recessed groove, and the recess being configured to be fitted to the protruding stripe so as to have the vertical members self-stand, with the proviso that each pillar with the protrusion at the upper end and the recess at the lower end is formed by laminating three vertical sawn plates of a same length and an identical material, in a plate thickness direction; and an eaves holder or upper rail including two or more boards configured to cover at least one side of the protruding stripe by covering the difference of the plate width of the back side joist and the plate width of the side joist.

7. A construction method for assembling a wooden construction having structural materials in which vertical members composing pillar materials or framework walls are fitted to horizontal members composing a lower frame and an upper frame at a construction site, the method comprising:

an alternative joint forming step for forming alternative joints at fitting parts of the structural materials, the alternative joint forming step including:

laminating three horizontal sawn plates with two or more different plate widths in a plate thickness direction so as to form one of the alternative joints over an entire length in a longitudinal direction of each one of the upper frame and the lower frame, and such that a recessed groove or a protruding stripe is formed in the longitudinal direction by a difference between an outer layer plate width of outer layer sawn plates of the three horizontal sawn plates interposing an intermediate layer sawn plate and an intermediate plate width of the intermediate layer sawn plate; and an assembly step for assembling the structural materials formed with the alternative joints, the assembly step including:

fitting the vertical members to the horizontal members at a position in a horizontal direction of the horizontal members such that the vertical members are self-standing, each vertical member of the vertical members including a protrusion at a first vertical end and a recess at a second vertical end opposite to the first vertical end, the protrusion being configured to be fitted to the recessed groove, and the recess being configured to be fitted to the protruding stripe, with the proviso that each vertical member with the protrusion at the first vertical end and the recess at the second vertical end is formed by laminating three vertical sawn plates of a same length and an identical material, in a plate thickness direction, and positioning eaves holders or upper rails including two or more boards positioned to cover at least one side of the protruding stripe.

8. The construction method according to claim 7, wherein:

the alternative joint forming step includes a pillar end recess and end protrusion forming step including laminating the three vertical sawn plates of the same length and the identical material in the plate thickness direction so as to form the alternative joints at opposite ends of each pillar of a plurality of pillars such that the recess or the protrusion configured to fit to the protruding stripe or the recessed groove is formed by deviating an intermediate sawn plate of the three vertical sawn plates in the longitudinal direction from two outer layer sawn plates of the three vertical sawn plates by an amount corresponding to the difference, and the assembly step includes:

arranging the lower frame;

standing the pillar of the plurality of pillars by fitting the recess at a lower end of each pillar of the plurality of pillars to the protruding stripe of the lower frame, and fitting the upper frame having the recessed groove so as to cover a top of the protrusion formed at an upper end of the standing pillar of the plurality of pillars.

9. The construction method according to claim 8, wherein the three horizontal sawn plates and the three vertical sawn plates are composed of solid wood, laminated wood, or laminated veneer lumber.

* * * * *